US009809999B2

(12) United States Patent
Weinerman et al.

(10) Patent No.: US 9,809,999 B2
(45) Date of Patent: Nov. 7, 2017

(54) LATCH APPARATUS

(71) Applicant: The Eastern Company, Cleveland, OH (US)

(72) Inventors: Lee S. Weinerman, Medina, OH (US); Grant A. Lugas, Elyria, OH (US)

(73) Assignee: THE EASTERN COMPANY, Cleveland, OH (US)

( * ) Notice: Subject to any disclaimer, the term of this patent is extended or adjusted under 35 U.S.C. 154(b) by 263 days.

(21) Appl. No.: 14/541,332

(22) Filed: Nov. 14, 2014

(65) Prior Publication Data

US 2015/0145265 A1 May 28, 2015

Related U.S. Application Data

(60) Provisional application No. 61/908,415, filed on Nov. 25, 2013.

(51) Int. Cl.
*E05B 47/00* (2006.01)
*E05B 81/28* (2014.01)
(Continued)

(52) U.S. Cl.
CPC ..... *E05B 47/0001* (2013.01); *E05B 81/06* (2013.01); *E05B 81/14* (2013.01);
(Continued)

(58) Field of Classification Search
CPC ..... E05B 81/34; E05B 81/28; E05B 81/64; E05B 85/02; E05B 79/04; E05B 81/68;
(Continued)

(56) References Cited

U.S. PATENT DOCUMENTS 4,342,209 A * 8/1982 Kleefeldt ..... E05B 77/48 292/DIG. 23
5,537,848 A * 7/1996 Grzanka ..... E05B 81/16 292/201

(Continued)

FOREIGN PATENT DOCUMENTS

DE 103 44 244 A1 4/2004
EP 0 106 725 A1 5/1983

(Continued)

OTHER PUBLICATIONS

International Search Report and The Written Opinion, PCT/US2014/066557, dated Feb. 5, 2015, Applicant: The Eastern Company.

*Primary Examiner* — Mark Williams
(74) *Attorney, Agent, or Firm* — Ralph E. Jocke; Walker & Jocke

(57) ABSTRACT

An actuator (24, 528, 606) is configured to cause a latch assembly (22, 322, 422, 522, 526, 604) to be changed from a closed condition in which an item is latched, to an open condition in which the item is unlatched. A catch jaw (30, 530) is operative in a first position to engage a member (106) connected to the item when the latch assembly is in the closed condition. The catch jaw in a second position enables the member to disengage from the catch jaw when the latch assembly is in the open condition. The actuator assembly includes a drive (152, 526, 608) and a gear system (157, 563, 610). The gear system is operative to move a release member (174, 538, 612). The release member is configured to be in operative connection with the catch jaw such that the movement of the release member causes the catch jaw to be enabled to move to the second position.

21 Claims, 12 Drawing Sheets

(51) Int. Cl.
*E05B 81/06* (2014.01)
*E05B 81/14* (2014.01)
*E05B 81/34* (2014.01)

(52) U.S. Cl.
CPC ..... *E05B 81/28* (2013.01); *E05B 81/34* (2013.01); *Y10T 292/1079* (2015.04)

(58) Field of Classification Search
CPC ..... Y10T 292/1018; Y10T 292/1079; Y10T 70/5907
USPC ..... 292/199
See application file for complete search history.

(56) References Cited

U.S. PATENT DOCUMENTS

| | | | | |
|---|---|---|---|---|
| 6,050,117 | A | 4/2000 | Weyerstall | |
| 2002/0050721 | A1* | 5/2002 | Kobayashi | E05B 85/01 292/216 |
| 2002/0167178 | A1* | 11/2002 | Spurr | E05B 77/02 292/201 |
| 2012/0259282 | A1* | 10/2012 | Alderete, Jr. | A61M 5/5086 604/131 |

FOREIGN PATENT DOCUMENTS

| | | | |
|---|---|---|---|
| EP | 0 119 133 | A1 | 5/1984 |
| EP | 1 734 209 | A2 | 12/2006 |
| FR | 2 803 619 | | 7/2000 |
| GB | 2 320 943 | A | 12/1997 |

* cited by examiner 342
340
338
334
332
330
328
326
324
322
320
318
316
314
312
310
308
306
304
302
300
298
296
294
292
290
288
286
284
282
280
278
276
274
272
270
268
266
264
262
260
258
256
254
252
250
248
246
244
242
240
238
236
234
232
230
228
226
224
222
220
218
216
214
212
210
208
206
204
202
200
198
196
194
192
190
188
186
184
182
180
178
176
174
172
170
168
166
164
162
160
158
156
154
152
150
148
146
144
142
140
138
136
134
132
130
128
126
124
122
120
118
116
114
112
110
108
106
104
102
100
98
96
94
92
90
88
86
84
82
80
78
76
74
72
70
68
66
64
62
60
58
56
54
52
50
48
46
44
42
40
38
36
34
32
30
28
26
24
22
20
18
16
14
12
10
8
6
4
2
M

LATCH APPARATUS

TECHNICAL FIELD

This invention relates to a latching mechanism for holding an item in a relatively fixed position and selectively releasing the item from engagement with the latching mechanism when desired.

BACKGROUND

Latches and particularly rotary type latches are useful for holding doors or other items in a fixed position. For example, the rotary latch may hold a door in a closed position closing a compartment. Latches may be selectively released when desired. Some latches may be opened or released manually through movement of one or more release levers in response to manual movement of an item such as a handle. Other latches may include an electrical actuator that is used to selectively release the latch. Such an electrical actuator may operate to release the latch in response to electrical signals. Some latches may include structures that enable the latch to be released either in response to manual movement or in response to an electrical actuator. Such latches and actuators may benefit from improvements.

SUMMARY

The following is a brief summary of the subject matter that is described in greater detail herein. This summary is not intended to be limiting as to the scope of the claims.

In one aspect of an exemplary embodiment, an actuator is provided that is configured for causing a latch assembly to be changed from a closed condition in which an item is held in latched engagement with the latch, to an open condition in which the item is unlatched and disengageable from the latch. The latch assembly includes a catch jaw. The catch jaw is movably configured to be in a first position to engage a member connected to the item when the latch assembly is in the closed condition. The catch jaw is configured to be movable to a second position in which the member may disengage from the catch jaw when the latch assembly is in the open condition.

The exemplary actuator assembly includes a drive and a gear system. The gear system is operatively connected to the drive. The gear system is configured to move a release member. The release member is operative to move in a first direction in response to operation of the drive. The release member is configured to be operatively associated with the catch jaw such that the movement of the release member a distance in a first direction enables the catch jaw to be movable to the second position. The exemplary actuator is a separate unit that may be releasably engaged with the latch assembly.

In another aspect of an exemplary embodiment, an apparatus is provided that includes a latch assembly. The latch assembly is operative to be placed in a closed condition for latching an item and an open condition for unlatching an item. The exemplary latch assembly comprises a moveable catch jaw. The catch jaw is operative in a first position to engage a member connected to the item when the latch assembly is in the closed condition. The catch jaw is configured to be selectively movable to a second position to allow the member to disengage from the catch jaw when the latch assembly is in the open condition. The exemplary apparatus further includes an actuator. The actuator includes a drive and a release member. The drive is in operative connection with the release member. The release member is in operative connection with the catch jaw. The release member is operative to linearly move a distance in a first direction in response to operation of the drive, wherein the linear movement of the release member in the first direction enables the catch jaw to move to the second position.

In another aspect of an exemplary embodiment, an apparatus is provided that includes a latch assembly. The latch assembly is configured to be selectively placed in a closed condition for latching engagement with an item and an open condition for unlatching an item. The exemplary latch assembly includes a moveable catch jaw. The catch jaw is operative in a first position to engage a member operatively connected to the item when the latch assembly is in the closed condition. The catch jaw is operative in a second position to allow the member to disengage from the catch jaw when the latch assembly is in the open condition. The exemplary apparatus further includes an actuator. The actuator includes a drive and a gear system. The drive is operatively connected to the gear system. The exemplary gear system moves a release member. The release member is operative to move a distance in a first direction in response to operation of the drive. The release member is configured to be operatively associated with the catch jaw such that the movement of the release member in the first direction enables the catch jaw to be moved to the second position. The exemplary actuator is a unit that is separable from the latch assembly.

Other aspects of exemplary embodiments will be explained with reference to the following detailed description and drawing figures.

BRIEF DESCRIPTION OF THE DRAWINGS

FIG. 14 is a plan view of an apparatus according to another exemplary embodiment with the front portion of the housing removed.

DETAILED DESCRIPTION

Figure 1:
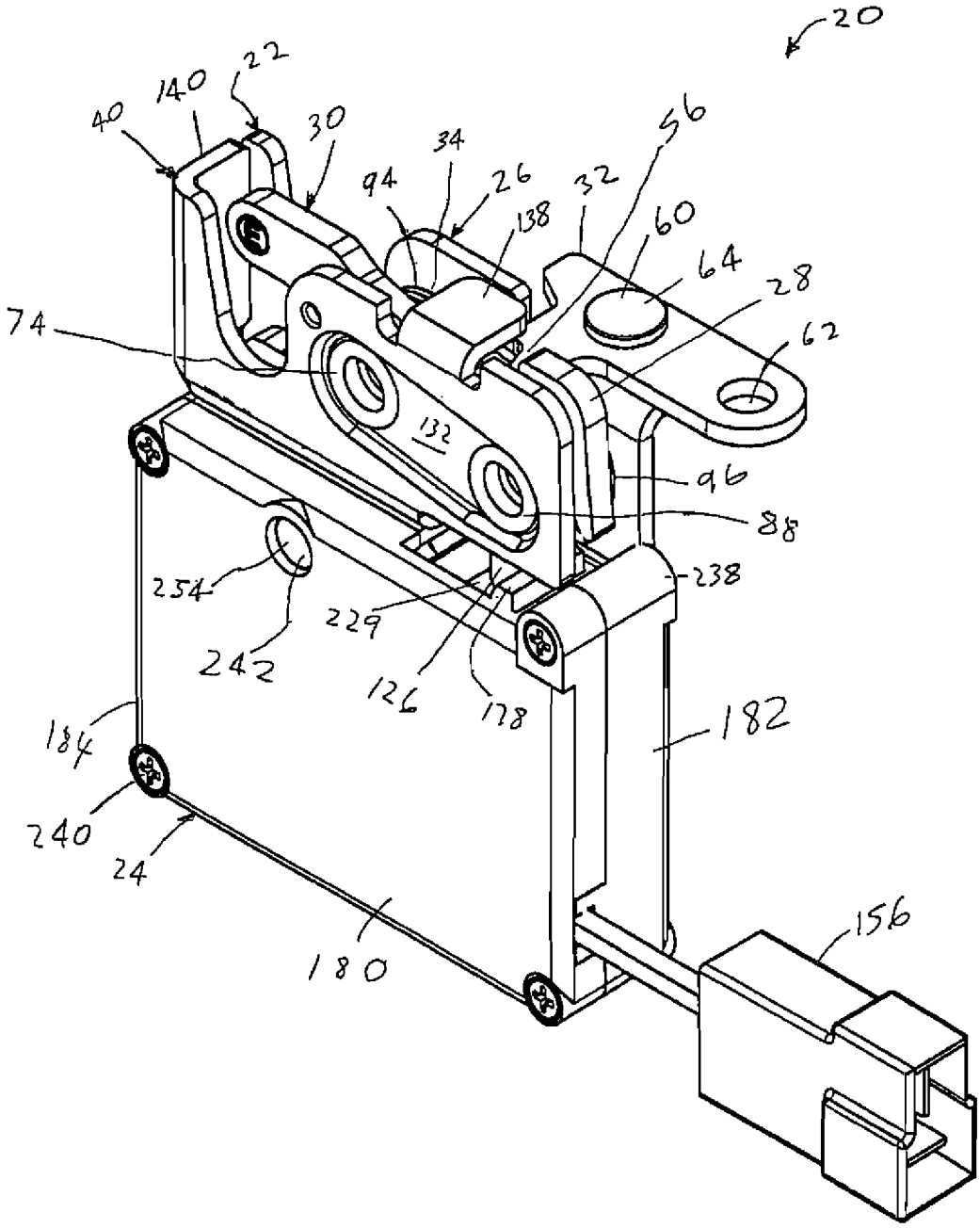
FIG. 1 is a front and right perspective view of an apparatus according to an exemplary embodiment.

Various features and relationships pertaining to exemplary embodiments of a latch apparatus and actuator will now be described with reference to the drawings, where like reference numerals represent like elements throughout. In the following description of the exemplary embodiments, the terms "clockwise", "counterclockwise", "front", "rear", "right", "rightwardly", "left", "leftwardly" "top", "bottom", "forwardly", "rearwardly", "upper", "upwardly", "lower", and "downwardly" are used with reference to the views of FIGS. 1-14 unless indicated otherwise. Those having ordinary skill in the art will recognize that these terms are used descriptively of the figures, and do not represent limitations on the scope of the claimed embodiments, as defined by the claims hereof.

With reference to FIG. 1, a front perspective view of an exemplary embodiment of an apparatus 20 is illustrated. The apparatus 20 may include a rotary latch assembly 22 and a separate electrical actuator 24 for actuating the latch assembly 22.

Figure 2:
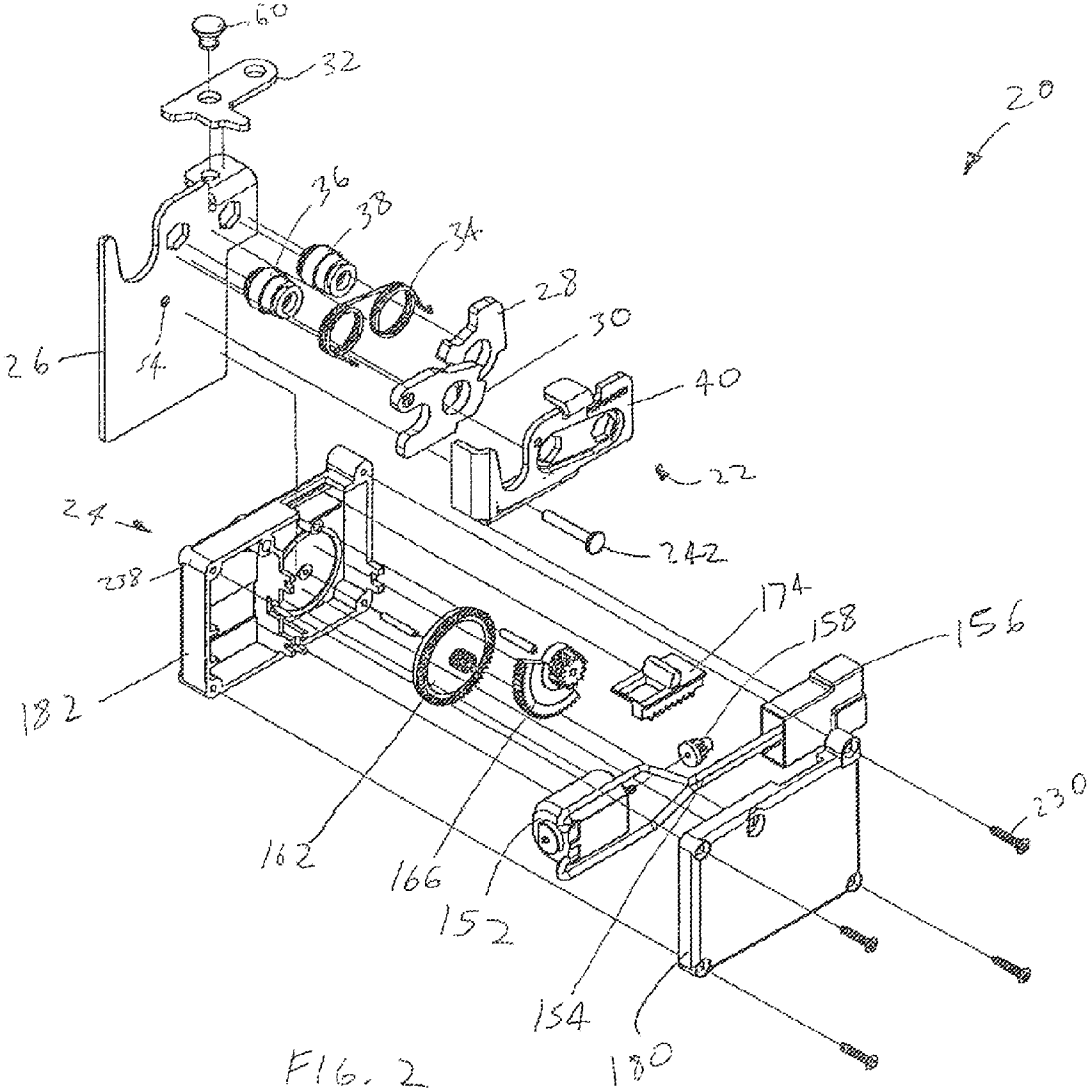
FIG. 2 is a front and left exploded view of the apparatus of FIG. 1.
Figure 3:
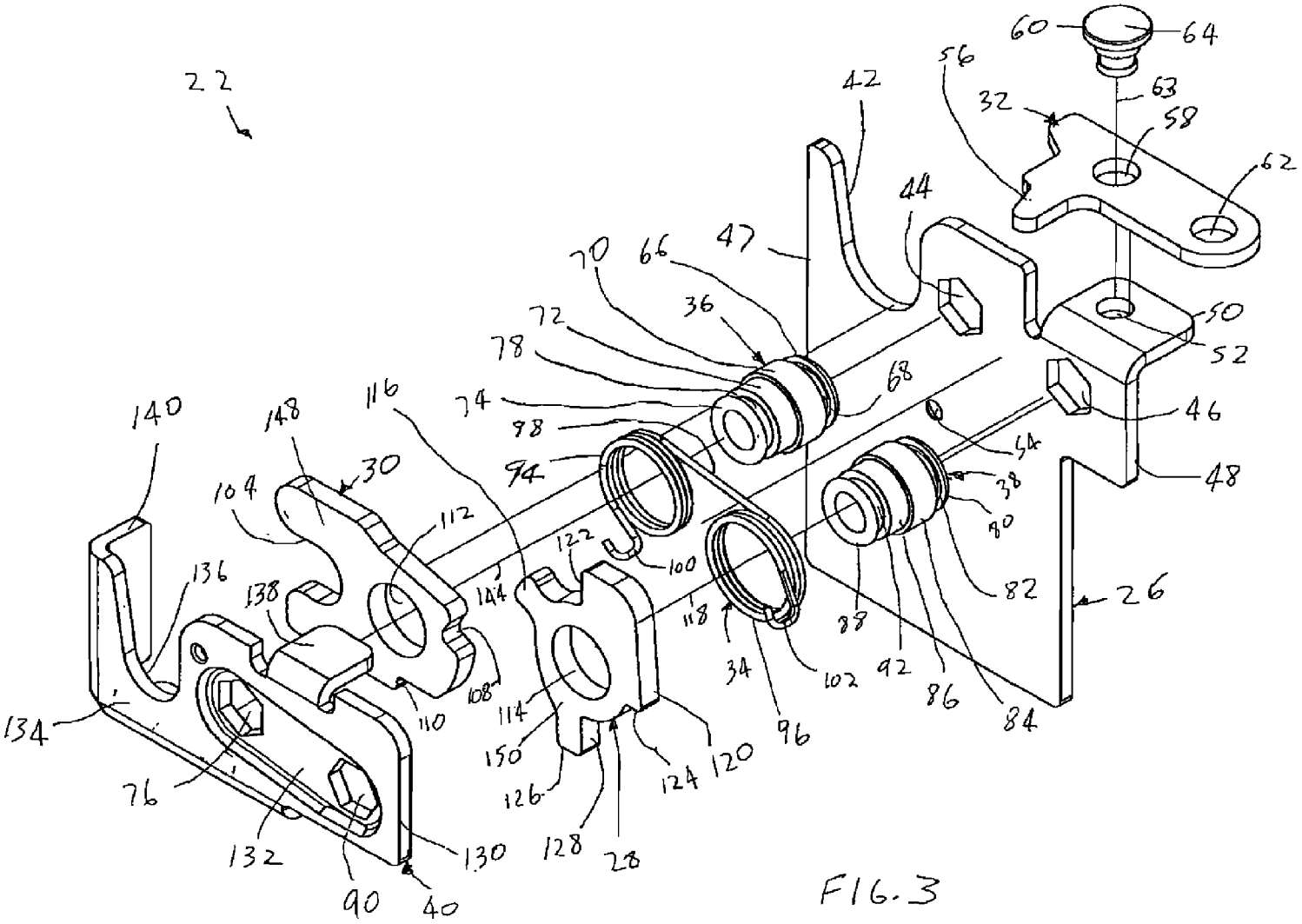
FIG. 3 is a front and right exploded view of the latch assembly of the apparatus of FIG. 1.

The exemplary actuator is used to selectively change the latch apparatus from a latched (closed) condition to an unlatched (open) condition. Of course this arrangement is exemplary and in other embodiments other arrangements may be used. As shown in FIGS. 2 and 3, the exemplary latch assembly includes a latch plate 26, release pawl 28, catch jaw 30, actuation or release lever 32, double torsion spring 34, first and second spacers 36, 38, and a cover plate 40. Referring to FIG. 3, the latch plate 26 includes a u-shaped cut out 42 formed in the upper edge of the latch plate 26 near the left side of the latch plate 26. First and second hexagonally shaped apertures 44, 46 are formed in the upper portion 47 of the latch plate 26. The second aperture 46 is formed in a right offset portion 48. A tab 50 is integrally formed with the upper end of the offset portion 46 and extends rearwardly from the upper end of the offset portion 46. The tab includes an aperture 52. The exemplary latch plate 26 further includes a mounting aperture 54 located below the first aperture 52 for receiving a rivet or other fastener for purposes later explained in detail. The exemplary latch plate 26 is formed in one piece of metal or other suitable rigid material.

The exemplary release lever 32 is formed from one piece of metal or other suitable rigid material. The release lever 32 includes a projection 56 located near the left side of the lever 32. The release lever 32 includes a pivot aperture 58 for rotatably receiving a shoulder rivet 60 and an aperture 62 for operative connection to a cable, rod or other member that can be moved in response to manual or other movement of an operatively connected handle or similar movable structure. The release lever 32 is rotatably mounted in connection with the tab 50 via the shoulder rivet 60 and rotates relative to the tab 50 about an axis 63. In particular, the shoulder rivet 60 extends through the aligned apertures 58, 52 of the release lever 32 and tab 50, with a head 64 of the rivet positioned upon the upper surface of the release lever 26 as also shown in FIG. 1.

Figure 8:
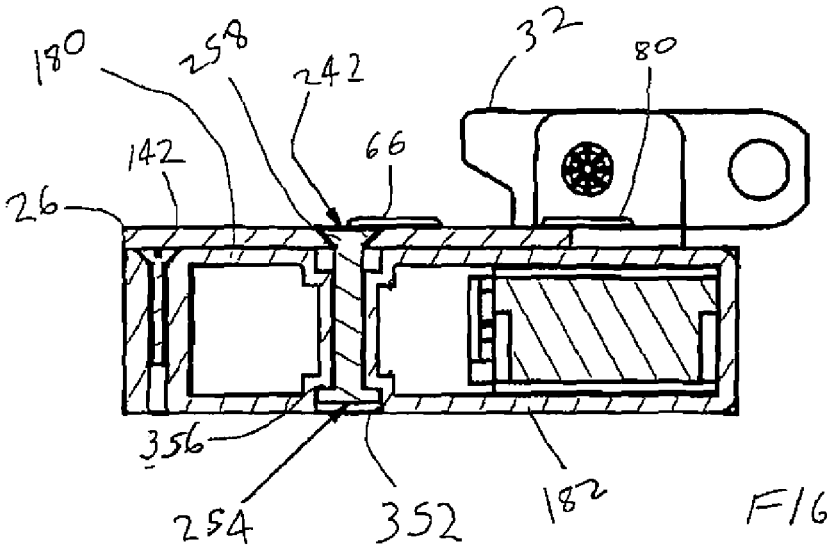
FIG. 8 is a sectional view taken along line 8-8 of FIG. 7 but viewed from the back or rear side of FIG. 7.

As represented in FIG. 3, the first spacer 36 of the exemplary arrangement is generally cylindrical in shape and formed as one piece. The first spacer 36 includes a rear annular flange 66 integrally formed around the rear end of the first spacer 36. The rear flange 66 is beveled (as also seen in FIG. 8), tapering rearwardly to facilitate insertion of the rear flange 66 of the first spacer 36 through the first aperture 44. An annular groove 68 is formed in the first spacer 36 and located forwardly adjacent the rear flange 66. The exemplary first spacer 36 also includes a central portion 70 for positioning the torsion spring 34. Forwardly adjacent the central portion 70 is a front annular portion 72 that has a smaller diameter than that of the central portion 70. The front annular portion 72 rotatably supports the catch jaw 30. The first spacer 36 includes a front annular flange 74 integrally formed around the front end of the first spacer 36. The front flange 74 is beveled, tapering forwardly to facilitate insertion of the front flange 74 through an aperture 76 of the cover plate 40. An annular groove 78 is formed in the first spacer 36 and located between the front flange 74 and front annular portion 72.

The exemplary second spacer 38 is similar in construction to the first spacer 36. In particular, the second spacer 38 is generally cylindrical in shape and formed as one piece. The second spacer 38 includes a rear annular flange 80 integrally formed around the rear end of the second spacer 38. The rear flange 80 is beveled (as also seen in FIG. 8), tapering rearwardly to facilitate insertion of the rear flange 80 of the second spacer 38 through the second aperture 46. An annular groove 82 is formed in the second spacer 38 and located forwardly adjacent the rear flange 80. The second spacer 38 also includes a central portion 84 for positioning the torsion spring 34. Forwardly adjacent the central portion 84 is a front annular portion 86 that has a smaller diameter than that of the central portion 84. The front annular portion 86 rotatably supports the release pawl 28. The second spacer 38 includes a front annular flange 88 integrally formed around the front end of the second spacer 38. The front flange 88 is beveled, tapering forwardly to facilitate insertion of the front flange 88 through an aperture 90 of the cover plate 40. An annular groove 92 is formed in the second spacer 38 and located between the front flange 88 and front annular portion 86.

The double torsion spring 34 of the exemplary arrangement serves as a unitary biasing device and includes first and second coils or spring portions 94, 96 that are connected together by an intermediate wire portion 98. The first and second coils 94, 96 include hooked ends 100, 102, respectively. Each coil provides rotatable biasing force relative to the center of each coil to allow both ends of the spring 34 to cause biased operation of latch components in the manner described. The exemplary double torsion spring 34 may be made of steel or other suitable material. Alternatively, the biasing device may have two separate torsion springs instead of the unitary double torsion spring. Other types of suitable biasing devices may also be used as well such as a linear-type (compression or tension) spring.

The exemplary catch jaw 30 is formed as one piece of a generally flat piece of rigid material and includes a recess 104 formed in a left end of the catch jaw 30 for receiving a member such as a post 106 (FIG. 5) that is operatively connected to a door or other item to be releasably held by the latch assembly. The exemplary catch jaw 30 includes a recess which is alternatively referred to as a detent 108 formed on the side surface thereof. The catch jaw 30 also includes a step surface 110 that extends on a lower end of the side of the catch jaw. An aperture 112 is formed generally in the center of the catch jaw for rotatably receiving the front portion 72 of the first spacer 36.

Figure 5:
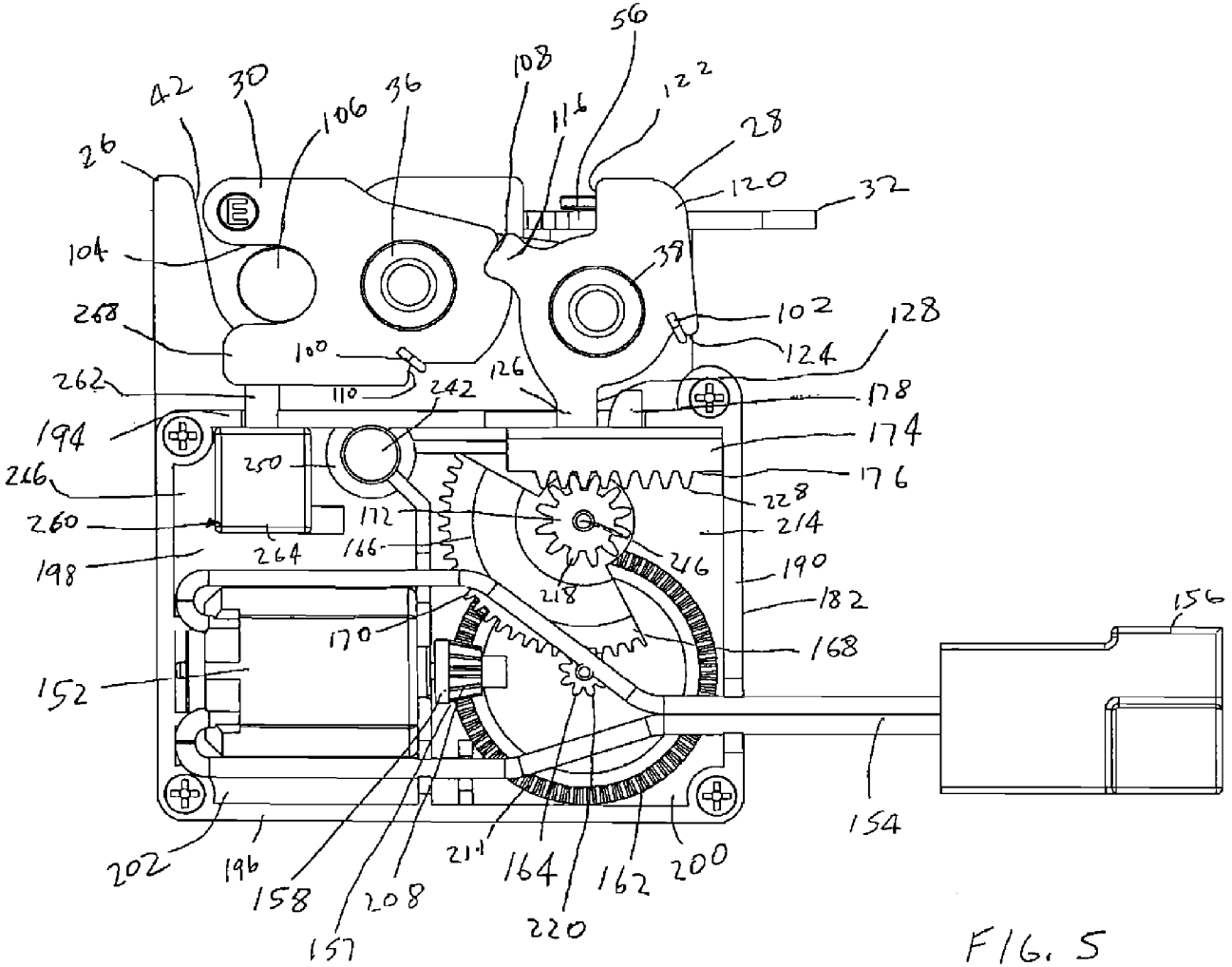
FIG. 5 is a front view of the apparatus of FIG. 1 with the latch assembly in the closed condition and with portions removed for illustrative purposes.

The exemplary release pawl 28 is formed as one generally flat piece of rigid material and includes an aperture 114 for receiving the front portion 86 of the second spacer 38. The release pawl 28 includes a first projection 116 extending radially outward (with respect to axis of rotation 118) from the upper left portion of the release pawl 28 as shown in FIG. 5. The release pawl 28 includes a second projection 120 extending radially outward from the upper right portion of the release pawl 28. The second projection 120 is bounded by upper and lower step surfaces 122, 124. The exemplary release pawl 28 includes a third projection 126 which serves as a release projection that extends radially outward from the lower end of the release pawl 28. The third projection 126 is bounded by a step surface 128.

The exemplary cover plate 40 is formed as one piece and includes a main body 130. A race track shaped recess 132 is formed in the front surface 134 of the main body 130. The recess 132 slopes upwardly in the left direction as shown in FIG. 3. Hexagonally shaped apertures 76, 90 are formed in the main body 130 and are located within the recess 132. A guide slot 136 is formed in the upper end of the main body 130 near the left end of the main body 130. The cover plate 40 includes a tab 138 that extends rearwardly from the upper end of the main body 130 as shown in FIG. 3. The exemplary guide slot 136 generally conforms in contour with cut out 42 of the latch plate 26. The cover plate 40 includes a shield 140 that extends rearwardly from the left side of the main body 130.

Figure 6:
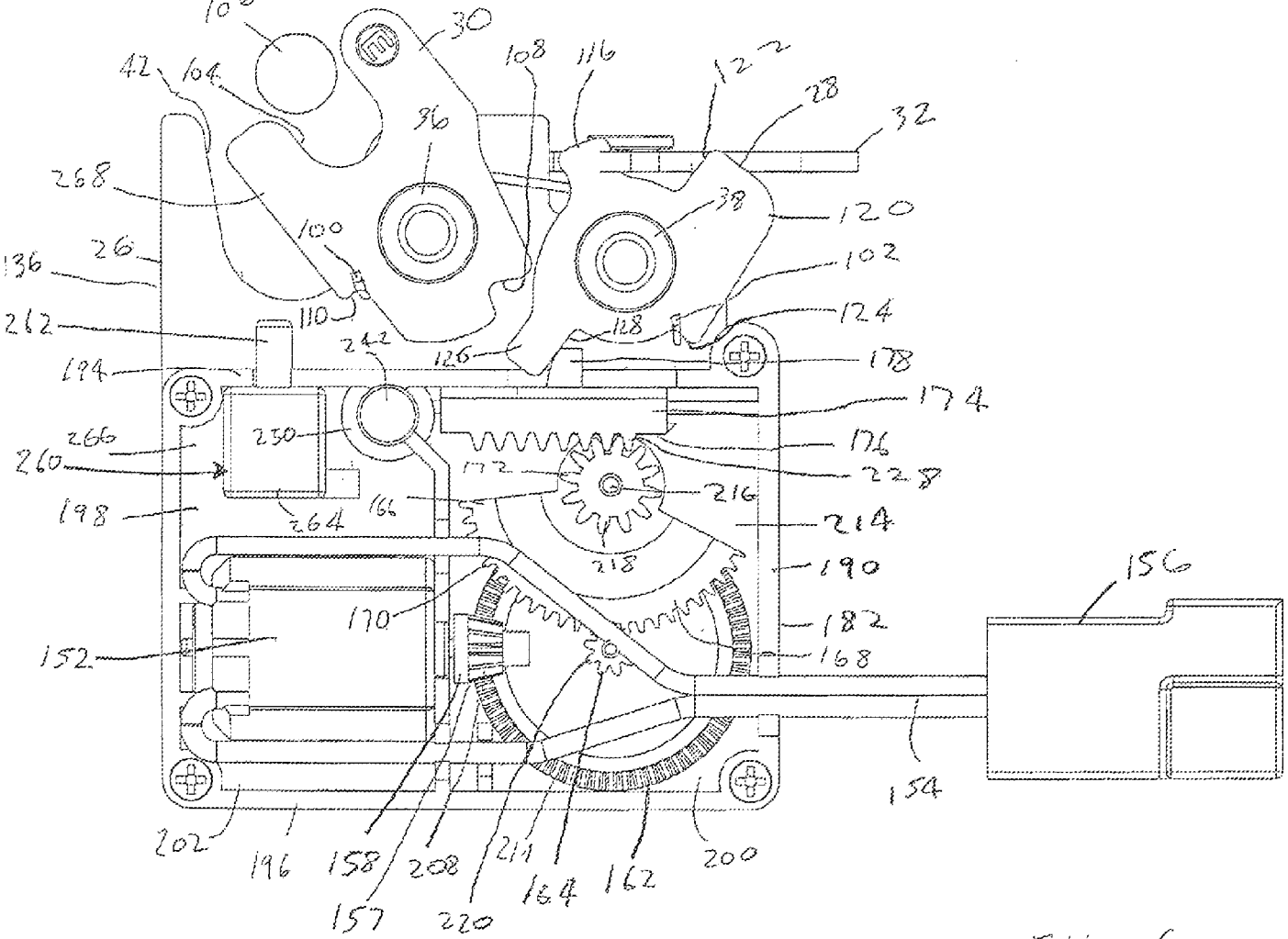
FIG. 6 is view similar to FIG. 5 except that the latch assembly is in the open condition.

When assembled, the first spacer 36 extends through the first aperture 44 of the latch plate 26 such that the latch plate 26 securely engages the groove 68. The rear flange 66 of the spacer engages a rear side 142 of the latch plate 26 to prevent disengagement of the first spacer 36 and the latch plate 26. The end portions of the latch plate 26 defining the hexagonal shape of the first aperture 44 help prevent rotation of the first spacer 36 relative to the latch plate 26. The first coil 94 of the torsion spring 34 extends around the central portion 70 of the first spacer 36. The catch jaw 30 is movably supported on the front portion 72 of the first spacer 36 such that the catch jaw 30 may rotate relative to the first spacer 36 about an axis 144. The hooked end 100 of the torsion spring 34 operatively engages the step surface 110 at the lower end of the catch jaw 30 as seen in FIGS. 5 and 6. The torsion spring 34 biases the catch jaw 30 in the clockwise direction as shown, towards a second position in which the post is disengageable from the recess 104 of the catch jaw.

Also in the exemplary arrangement, when assembled, the second spacer 38 extends through the second aperture 46 of the latch plate 26 such that the latch plate 26 securely engages the groove 82. The rear flange 80 of the spacer engages the rear side 142 of the latch plate 26 to prevent disengagement of the second spacer 38 and the latch plate. The end portions of the latch plate 26 defining the hexagonal shape of the second aperture 46 help to prevent rotation of the second spacer 38 relative to the latch plate 26. The second coil 96 of the torsion spring 34 extends around the central portion 84 of the second spacer 38. The release pawl 28 is movably supported on front portion 86 of the second spacer 38 such that the release pawl 28 may rotate relative to the second spacer 38 about the axis 118. The hooked end 102 of the torsion spring 34 operatively engages the lower step surface 124 of the second projection 120 as shown in FIGS. 5 and 6. The torsion spring 34 biases the release pawl 28 in the counterclockwise direction as shown in FIG. 5 toward a first position. The projection 56 of the release lever 32 is positioned adjacent the upper step surface 122 of the second projection 120 of the release pawl 28.

In the exemplary embodiment, the first and second spacers 36, 38 extend through their respective apertures 44, 46 of the cover plate 40 such that the cover plate 40 securely engages the respective spacer grooves 78, 92. The front flanges 74, 88 extend through respective apertures in the cover plate and engage the front surface 134 of the cover plate 40 at the recess to prevent disengagement of the cover plate 40 and the spacers 36, 38, as represented in FIG. 1. The hexagonal apertures 76, 90 in the cover plate 40 help to prevent rotation of the spacers 36, 38 relative to the cover plate. As seen in FIG. 1, the cover plate 40 overlies the front sides 148, 150 (FIG. 3) of the catch jaw 30 and the release pawl 28, respectively, and the recess 104 of the catch jaw 30 to minimize external access to the release pawl 28 and the catch jaw 30. The exemplary tab 138 overlies the first projection 116 of the release pawl 28, the detent 108 of the catch jaw 30, and the projection 56 of the release lever 32 to minimize access to these elements. This reduces the risk that a criminal or other unauthorized person may use a tool to move the release pawl 28 and open the latch assembly 22 improperly. Other forms of cover plates or other or additional structures may be used in connection with different embodiments of latch assemblies to minimize the risk of unauthorized access and latch release.

As shown in FIG. 5, when the exemplary latch assembly 22 is in the closed condition for latching and holding an item, the catch jaw 30 is positioned in a first position to engage the post 106 and hold the post in the recess 104. In this condition, the shield 140 as well as the surfaces bounding the guide slot 136 and the cut out 42 prevent disengagement of the post 106 from the catch jaw of the latch assembly 22. In the closed condition, the first projection 116 of the release pawl 28 engages the detent 108 of the catch jaw 30 to prevent clockwise rotation of the catch jaw 30. In this first position of the release pawl 28, the second coil 96 of the spring 34 biases the first projection 116 counter clockwise as shown to engage the detent 108 with a force sufficient to counteract the biasing force of the first coil 94 acting to bias the catch jaw 30 in a clockwise direction, thereby holding the catch jaw 30 in the first position in holding engagement with the post 106. As a result the item to which the post is operatively connected, such as a door, is held in a position due to the closed condition of the latch. Alternatively, in other arrangements the detent and first projection features could be reversed on the release pawl and catch jaw such that the catch jaw has a projection that engages a detent of the release pawl to hold the catch jaw in the engaged position with the post. Also, in alternative arrangements, there may be intermediate structures acting operatively between the catch jaw and release pawl to allow the release pawl to hold or release the catch jaw in the first position.

The exemplary latch assembly 22 may be placed in the released or open condition for unlatching an item as represented in FIG. 6. To place the exemplary latch assembly 22 in the open condition, a user grasps a handle operatively connected to the cable, rod or other member, which is attached to the release lever 32 via the aperture 62, and applies a manual force to move the member in the rearward direction, which in turn rotates the release lever 32 about the axis 63. Rotation of the release lever 32 causes the projection 56 to engage the upper step surface 122 and rotate the release pawl 28 clockwise as shown in FIG. 5. The relative movement of the release pawl with respect to the catch jaw causes the first projection 116 to disengage from the detent 108 of the catch jaw 30 when sufficient force is applied by the user to move the release pawl by overcoming the biasing force of the second coil 96 of the spring 34 acting on the release pawl 28.

In the exemplary arrangement disengagement of the first projection 116 and the detent 108 releases the holding force of the first projection 116 of the release pawl 28 acting against the detent 108 of the catch jaw 30. The biasing force of the first coil 94 of the spring 34 acting on the catch jaw 30 rotates the catch jaw 30 in the clockwise direction as shown in FIG. 5 to a second position in which the post is released by the catch jaw and the post can disengage from the latch. Rotation of the catch jaw 30 in the clockwise direction to the second position by the spring 34 urges the post 106 to move in the guide slot until the post 106 and recess 104 disengage and the post can be disposed away from the guide slot 136 and the shield 140. The post 106 moves relative to and may disengage from the latch assembly 22. This enables the door or other item operatively engaged with the post 106 to be released from operative engagement with the latch and moved relative thereto. For example if the item is a door it may be opened.

Figure 4:
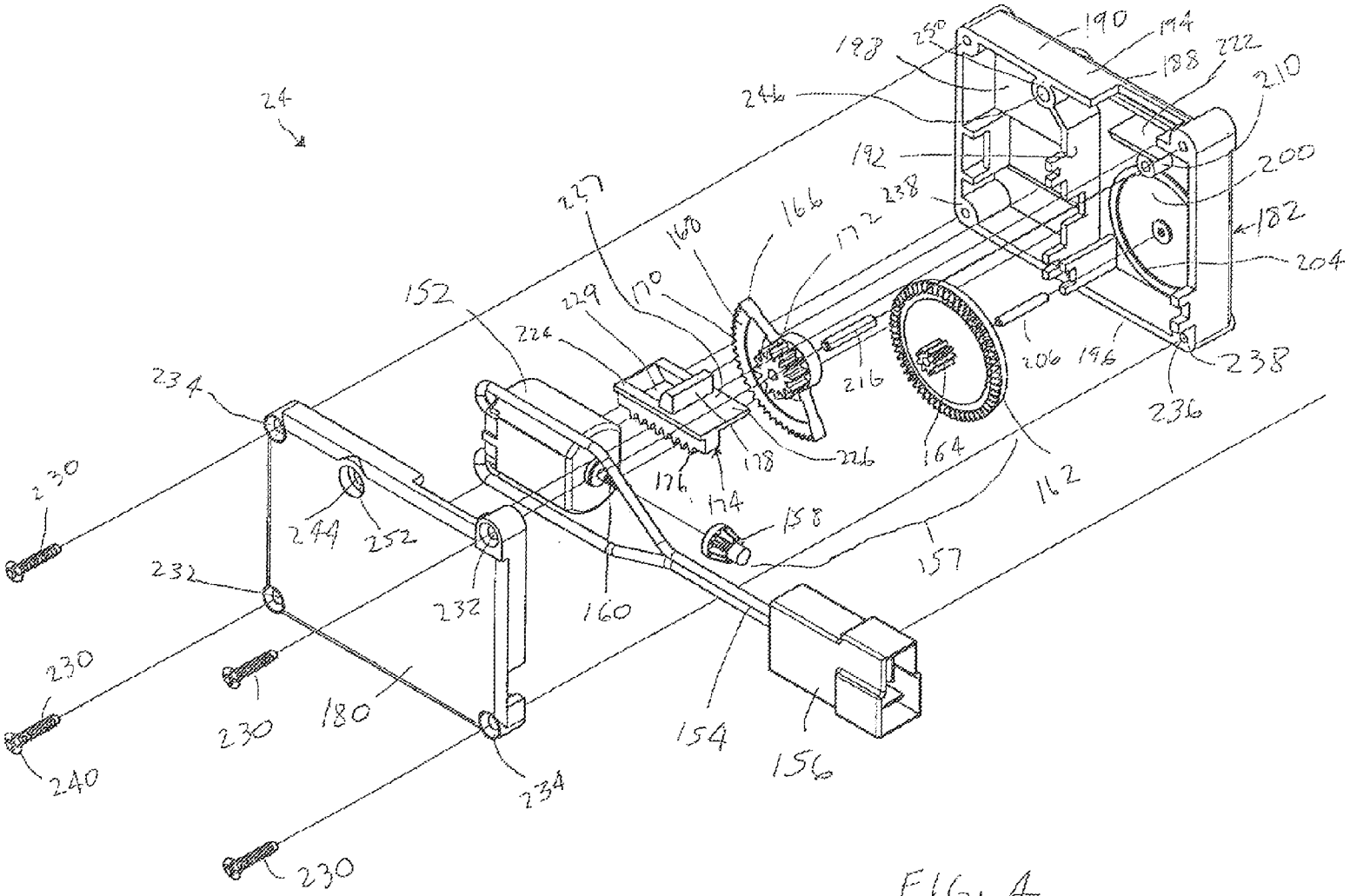
FIG. 4 is a front and right exploded view of the actuator of the apparatus of FIG. 1.

In addition or alternatively, the exemplary latch assembly 22 may be changed to the open condition from the closed condition through operation of the actuator 24. In particular, as depicted in FIGS. 2 and 4, the exemplary actuator 24 comprises a drive such as a motor 152. The motor 152 may be an air motor, electric motor, hydraulic motor or other suitable type of motor. Alternatively, solenoids or other suitable drives may be used instead of a motor. The motor 152 may be powered via wires 154 by a power source such as a 110 volt alternating current power source such as a household outlet or a 12 volt DC battery. The wires 154 may also be connected to a wire harness 156.

Referring to FIG. 4, the exemplary electrical actuator 24 further comprises gear system which is alternatively referred to as a gear train 157. The exemplary gear system 157 includes a pinion 158 fixed to the end of a rotating shaft 160 of the motor 152. The gear system 157 also includes an annular arcuate gear portion in the form of ring gear 162. The exemplary ring gear 162 includes an integrally formed central pinion 164 located at the center of the ring gear 162. The ring and central pinion comprise a first pair of reduction gears. The exemplary gear system 157 further comprises a rack drive gear 166. The rack drive gear 166 includes an arcuate gear portion 168 that has teeth 170 on a lower end of the gear portion 168. A pinion 172 extends in fixed relation on the central portion of the arcuate gear portion 168. The pinion 172 rotates co-axially with the gear portion 168. The drive gear 166 and pinion 172 serve as a second pair of reduction gears. The exemplary gear system 157 further includes an elongated release member 174. The exemplary release member includes a linear gear rack 176 at an inner side of the release member 174. An upstanding finger 178 extends on the top of the release member 174. The left side of the exemplary finger 178 slopes downwardly and outwardly toward the left direction. A recess 229 extends in an outer surface of the release member.

As shown in FIG. 4 the exemplary actuator assembly 24 further includes front and rear casings 180, 182, respectively. The casings define a housing 184 that generally surrounds the motor 152 and gear system 157. The rear casing 182 includes a rear base 188 and a peripheral wall 190 extending forwardly from the periphery of the base 188. A divider wall 192 extends between the upper and lower portions 194, 196 of the peripheral wall 190 to define, along with the peripheral wall 190, left and right compartments 198, 200. As shown in FIGS. 5 and 6, the motor 152 is positioned in the lower portion 202 of the left compartment 198, and the ring gear 162 is rotatably movable in a complimentary recess 204 (FIG. 4) formed in the right compartment 200. The ring gear 162 may rotate about an axis of rotation about an axle 206 that extends in the rear casing 182 and through the center of the ring gear 162. The teeth 208 of the pinion 158 on the drive shaft of the motor 152 engage the teeth 211 of the ring gear 162. The rack drive gear 166 is rotatably supported by a boss 210 (FIG. 4) in the upper portion 214 of the right compartment 200. The rack drive gear 166 may rotate about an axis of rotation about an axle 216 that extends through the pinion 172 and into a bore in the boss 210. Teeth 220 of the pinion 164 engage the teeth 170 of the arcuate gear portion 168.

The exemplary release member 174 has a main body 227 (FIG. 4) that is movably supported on a support ledge 222 (FIG. 4) of the rear casing 182. Left and right end portions 224, 226 (FIG. 4) of the body 227 of the release member 174 are configured to be movably positioned under the upper portion 194 of the peripheral wall 190 and may slidably contact the underside of the upper portion 194 during movement of the release member 174 as shown in FIGS. 5 and 6. The teeth 228 of the gear rack 176 engage the teeth 218 of the pinion 172 of the rack drive gear 166. Thus, rotation of the pinion 172 in the counterclockwise direction moves the release member 174 linearly along a straight line from right to left as shown in FIGS. 5 and 6. The end portions 224, 226 of the release member 174 are movably positioned underneath the upper portion 194 during the linear movement of the release member 174 and serve to hold the release member 174 in engagement with the housing.

Referring to FIG. 4, the exemplary front casing 180 is in mounted connection with the rear casing 182 by fasteners such as screws 230. Specifically, four screws 230 extend through four corresponding apertures 232 in corner recesses 234 of the front casing and threadably engage bores 236 formed in the four corner portions 238 of the peripheral wall 190 of the rear casing 182. The heads 240 of the screws 230 are positioned on the front side of the recesses 234 to secure the front casing 180 in engaged relation with the rear casing 182.

The exemplary actuator 24 is a separable unit from the latch assembly 22 as best illustrated in FIG. 2. The exemplary actuator 24 is in mounted relation with the latch assembly 22 through at least one a suitable fastener 242. For example, the fastener may include a releasable fastening rivet 242 (FIGS. 2 and 8) that extends through aligned apertures 244, 246 (FIG. 4), and 54 (FIG. 3), in the front casing 180, a boss 250 of the rear casing 182, and the latch plate 26, respectively, to releasably secure the actuator assembly 24 to the latch plate 26 of the latch assembly 22. In particular, the aperture 244 of the front casing 180 may be formed in a recess 252 (FIG. 4). As shown in FIG. 1, the rivet 242 may include a head 254 that is positioned upon a front side of the recess 252 and a bucked or upset tail 258 (FIG. 8) that is securely positioned in the aperture 54 (FIG. 3) of the latch plate 26 to secure the latch plate 26 to the front and rear casings 180, 182. The rivet 242 may hold the actuator and latch assembly 24, 22 engaged by an internal fastener such as a screw, nut, stud or other suitable member. In other arrangements the rivet may be of the type that provides a generally permanent fastening engagement such as a rivet that is deformed in place such as by an orbital riveter. Of course these fastening arrangements are exemplary. In this exemplary embodiment, the rear casing 182 is positioned adjacent the latch plate 26, when the actuator 24 is mounted to the latch assembly 22.

In other arrangements, other types of fastening arrangements may be used. For example, one or more bolts or screws may extend through the apertures with a nut threadably fastened thereto to secure the actuator and the latch plate in engaged relation. The fasteners may be constructed so that the actuator 24 may be removably mounted to the latch plate 26 of the latch assembly 22. This feature may readily enable the latch assembly 22 (without the actuator 24 attached thereto), to operate solely manually using the release lever 32. The separate actuator 24 being attached to the latch assembly 22 enables the same configuration of the latch assembly 22 to be released either electrically or manually. Alternatively the exemplary latch assembly configuration may also be operated without the manual release lever, so that the latch assembly can be released solely by the electrical actuator assembly 24. Of course these configurations are exemplary.

Exemplary embodiments of the apparatus 20 also enable the actuator 24 to be installed in operative engagement with the latch assembly 22 either in the factory or in the field. This configuration may enable a user to change latch assemblies to add or remove an actuator assembly as desired in the particular environment where the latch assembly is used. The separate actuator configuration also makes it easier to replace a broken actuator, since there is no need to disassemble other parts of the latch assembly. The separate actuator assembly may also provide a more economical construction. The removable actuator assembly may also enable the use of different types of actuators with the same components of the mechanical latch assembly. This may include, for example, actuators with motors that run at different voltages. This may be desirable depending on the applications in which the latch assembly is used. For example, latch assemblies on vehicles may use a 12 volt DC motors. Actuators used in stationary applications may use 110 volt AC motors or motors that operate at other suitable voltages.

FIGS. 5 and 6 illustrate the operation of the exemplary actuator 24. When the latch assembly 22 is in the closed condition, the finger 178 of the release member 174 is position rightwardly adjacent the step surface 128 that bounds the third projection 126 of the release pawl 28 as depicted in FIG. 5. The exemplary third projection 126 extends in the a recess 229 formed in the top of the main body 227 of the release member 174, which recess is best shown in FIG. 4. To change the latch assembly 22 from a closed condition to the open condition via the actuator assembly 24, the motor 152 is energized by, for example, a user pushing a push button or changing the condition of a switch (not shown). Energization of the motor 152 rotates the motor shaft 160 and pinion 158 fixed thereon clockwise (as viewed in FIG. 2). Rotation of the pinion 158 in turn rotates the ring gear 162 and its central pinion 164 in the clockwise direction. The central pinion 164 rotates the arcuate gear portion 168 and hence, the pinion 172 of the rack drive gear 166, counter clockwise. As shown in FIG. 6, rotation of the pinion 172 of the rack drive gear 166 in turn moves the release member 174 linearly along a straight line to the left in a direction towards the step surface 128 bounding the third projection 126. The finger 178 engages the step surface 128 and rotates the release pawl 28 from the first position to the second position such that the first projection 116 disengages the detent 108 of the catch jaw 30 when sufficient force is applied by the motor 152 to overcome the biasing force of the second spring coil 96.

Disengagement of the first projection 116 and the detent 108 releases the holding force of the first projection 116 of the release pawl 28 acting against catch jaw 30. The biasing force of the first coil 94 of the spring 34 acting on the catch jaw 30 rotates the catch jaw 30 in the clockwise direction from the first position shown in FIG. 5 to the second position shown in FIG. 6. Rotation of the catch jaw 30 in the clockwise direction to the second position by the spring 34 biases the post 106 to move in the guide slot 136 until the post 106 and the recess 104 disengage. The post 106 moves out of the recess 104 of the catch jaw and the guide slot 136 and disengages from the latch assembly 22. This enables the door or other item that is operatively connected to the post 106 to be moved relative to the latch. For example, if the post is in operative connection with a door, the door can be opened.

The relatively large sized ring gear 162 and rack drive gear 166 of the exemplary arrangement function as reduction gears to reduce the force required by the motor 152 to overcome the biasing force of the second spring coil 96 and move the release member 174 to in turn rotate the release pawl 28 until the first projection 116 disengages from the detent 108. Thus, the two pairs of reduction gears of the gear system 157 of the exemplary actuator assembly 24 provides sufficient force to cause the release member 174 to move the release pawl 28 and reliably release or open the latch assembly 22 without the need for a high torque driving motor. Also, the straight linear movement of the release member 174 during movement of the release member 174 causes a generally constant uniform force to be applied by the finger 178 generally perpendicular to the step surface 128 as the release pawl 28 rotates from the first position to the second position. This in turn enables the use of a driving motor with lower torque, as a suitable amount of force is uniformly applied in a suitable direction by the release member 174 to the step surface 128 to rotate the release pawl 28 from the first position to the second position and place the latch assembly 22 in the open condition.

As shown in FIGS. 5 and 6, in this exemplary arrangement a sensing switch 260 is provided and can be used to determine whether the latch assembly 22 is in the open or closed condition. The exemplary sensing switch comprises a plunger type switch 260 in which a plunger 262 moves in and out relative to a switch body 264. In particular, the exemplary switch 260 is positioned in an upper portion 266 of the left compartment 198 of the rear casing 182. When the latch assembly 22 is in the open condition and the catch jaw 30 is in the second position as seen in FIG. 6, the plunger 262 of the switch 260 biasingly extends upwardly terminating just underneath a left portion 268 of the catch jaw 30 located to the left of the axis 144. When the latch assembly 22 is in the closed condition and the catch jaw 30 is in the first position as seen in FIG. 5, the left portion 268 of the catch jaw 30 engages the plunger 262 and depresses the plunger 262 against the outward biasing force of a spring or other suitable device down toward the switch body 264. This enables the switch 260 to detect the condition of the latch.

An indicator (not shown) may be electrically coupled to the switch 260 to indicate whether the latch assembly 22 is in the closed or open condition. For example, for a plunger switch 260 that is a normally closed circuit type switch, the indicator may be a light that is illuminated to indicate that the latch assembly 22 is in the open condition and the catch jaw 30 is in the second position. The light may be off when the latch assembly 22 is in the closed condition and the catch jaw 30 is in the first position. Specifically, in the closed condition, the left portion 268 of the catch jaw 30 engages the plunger 262 and pushes the plunger 262 down toward the switch body 264 to break the circuit and cut the power to the light. The light being turned off may also indicate to the user that the door or other item operatively connected to the post 106 is fully closed. Other types of indicators may be used such as display screens or audible indicators. As previously mentioned, in the exemplary arrangement, the plunger switch 260 may be positioned inside the left compartment 198 of the rear casing 182. Alternatively, when the latch assembly 22 is used without the actuator 24, or in other exemplary arrangements the plunger switch 260 may be operatively attached separately to the latch plate 26.

Figure 7:
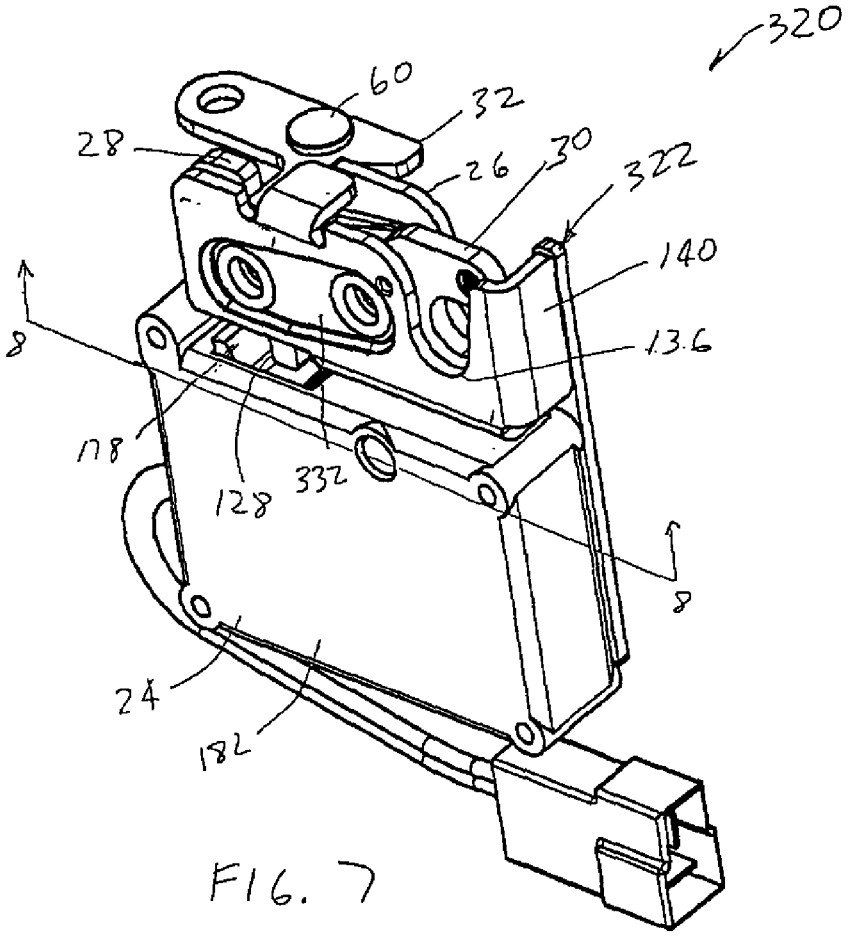
FIG. 7 is a front and right perspective view of an apparatus according to another exemplary embodiment.

The exemplary actuator 24 may be used with other types of latch assemblies. For example, FIGS. 7 and 8 show an exemplary apparatus 320 in which the actuator 24 is used with a different type of latch assembly 322. This exemplary apparatus 320 is similar to the apparatus 20 of FIGS. 1-6 except as discussed below. The same reference numbers will be used to designate elements of the apparatus 320 generally similar in construction and function as the apparatus 20 of FIGS. 1-6.

In this exemplary latch assembly 322, the latch plate 26, catch jaw 30, and release pawl 28 are flipped 180 degrees relative to a vertical axis (as compared to FIG. 1). The locations of the release pawl 28 and catch jaw 30 are reversed compared to the previously described embodiment. The hooked end 100 of the spring 34 operatively engages the lower step surface 124 to bias the release pawl 28 to the first position, and the hooked end of 102 of the spring 34 operatively engages the step surface 110 to bias the catch jaw 30 to the second position. When the latch assembly is in the closed condition, the first coil 94 of the spring 34 biases the first projection 116 to engage the detent 108 with a force sufficient to counteract the biasing force of the second coil 96 against the catch jaw 30, thereby holding the catch jaw 30 in the first position in engaging relation with the post 106.

As in the previously described embodiment, in this exemplary apparatus 320, the tab 50 of the latch plate 26 extends rearwardly from the latch plate 26. The release lever 32 is flipped 180 degrees about a horizontal axis compared to the prior arrangement. The guide slot 136 and shield 140 of the cover plate 40 are located on the right side instead of the left side, and the recess 132 of the main body slopes upwardly to the right as shown. The actuator 24 is generally the same as in the previously described embodiment and in this arrangement is engaged with the latch plate 26 such that the front casing 180 rather than the rear casing 182 is positioned adjacent the latch plate 26. In particular, the rear casing 182 includes a recess 352. As shown in FIG. 8, the rivet 242 extends through the recess 352, aperture 244 of the front casing 180, and aperture 54 of the latch plate 26, such that the head 254 of the rivet 242 is positioned on a rear side 356 of the recess 352 and the bucked or upset tail 258 is securely positioned in the aperture 54 (FIG. 3) of the latch plate 26 to secure the latch plate 26 to the front and rear casings 180, 182.

In this exemplary alternative apparatus 320, the finger is located leftwardly adjacent the third projection 126 of the release pawl 28, when the latch assembly 322 is in the closed condition. To change the latch assembly 22 from the closed condition to the open condition via the actuator 24, the motor 152 is energized by, for example, a user pushing a push button or changing the condition of a switch (not shown). Energization of the motor rotates the motor shaft and the pinion thereon. Rotation of the pinion in turn rotates the ring gear 162 and the central pinion 164. The central pinion 164 rotates the gear portion 168 and hence, the pinion 172. Rotation of the pinion 172 in turn moves the release member 174 linearly to the right (as viewed in FIG. 7) towards the step surface 128 bounding the third projection 126. The finger 178 engages the step surface 128 and rotates the release pawl 28 clockwise (as viewed from back or rear side of the latch in FIG. 7) from the first position to the second position such that the first projection 116 disengages from the detent 108 of the catch jaw 30 when sufficient force is applied by the motor and gear system 152 to overcome the biasing force of the first coil 94.

Disengagement of the first projection 116 and the detent 108 releases the holding force of the first projection 116 of the release pawl 28 acting on the catch jaw 30 such that the biasing force of the second coil 96 of the spring 34 against the catch jaw 30 rotates the catch jaw 30 from the first position to the second position. Rotation of the catch jaw 30 to the second position by the spring 34 urges the post 106 to move outwardly along the guide slot until the post 106 disengages the recess 104. The post 106 disengages recess 104 and disengages from the latch assembly 22. This enables the door or other item operatively connected to the post 106 to be moved relative to the latch.

To manually place the exemplary latch in the open condition, a user grasps a handle attached to a cable, rod or other member, which is attached to the release lever via the aperture, and applies a manual force to move the member, which in turn rotates the release lever about its axis. Rotation of the release lever 32 causes the first projection 116 to engage the upper step surface 122 and rotate the release pawl 28 clockwise (as viewed from the back or rear side of the latch in FIG. 7) to the second position such that the first projection 116 disengages from the detent 108 of the catch jaw 30 when sufficient force is applied by the user to overcome the biasing force of the first coil 94 of the spring 34 against the release pawl 28. Disengagement of the first projection 116 and the detent 108 releases the holding force of the first projection 116 of the release pawl 28 such that the biasing force of the second coil 96 of the spring 34 acting on the catch jaw 30, rotates the catch jaw 30 in the clockwise direction (as viewed from the back or rear side of the latch in FIG. 7) to a second position. Rotation of the catch jaw 30 in the clockwise direction to the second position by the spring 34 urges the post 106 to move along the guide slot 136 until the post 106 and recess 104 disengage, allowing the post 106 to disengage from the latch assembly 22. This enables the door or other item operatively connected to the post 106 to be opened or otherwise moved relative to the latch.

Figure 9:
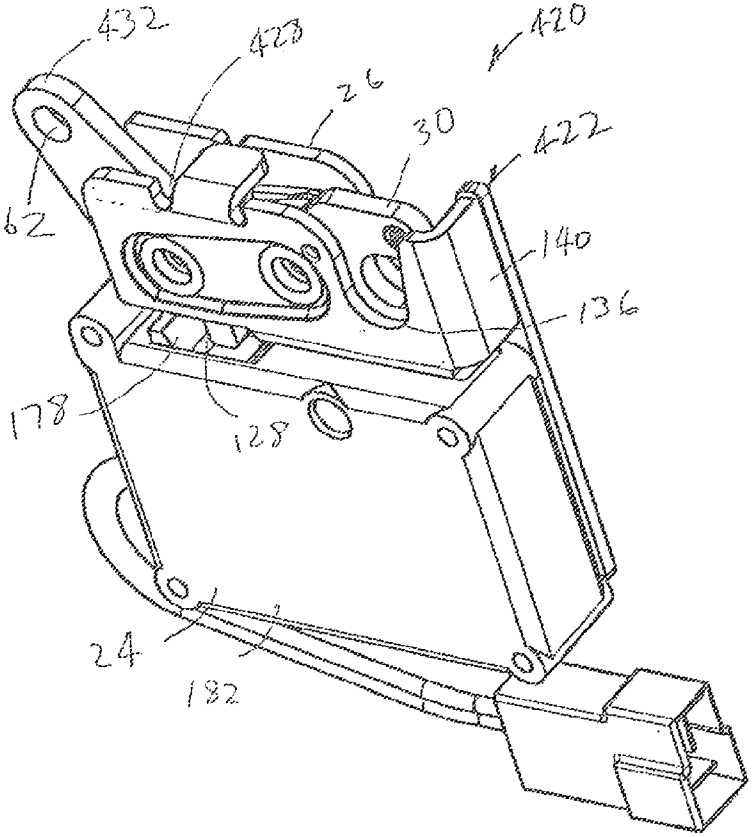
FIG. 9 is a front and right perspective view of an apparatus according to another exemplary embodiment.

FIG. 9 shows a further exemplary apparatus 420 in which the actuator 24 is used with a different type of latch assembly 422. This exemplary apparatus 420 is similar to the apparatus 320 of FIGS. 7 and 8 except as discussed below. The same reference numbers will be used to designate elements of the apparatus 420 similar in construction and function as the apparatus 320 of FIGS. 7 and 8. In this latch assembly 422, the release lever and tab are not included. Instead an ear 432 is integrally formed as one piece with the release pawl 428. The ear 432 extends radially outward (with respect to the axis of rotation of the release pawl) from the upper left corner of the release pawl 428 as shown in FIG. 9. The ear 432 includes an aperture 62 for securely receiving a cable, rod or other member that can be attached to a handle or other item to provide manual or other movement by a user or device.

In an exemplary arrangement when a user pulls the handle to cause the ear 432 to move downwardly with sufficient force to overcome the biasing force of the spring 34, the release pawl 428 rotates clockwise (as viewed from the back or rear side of the latch in FIG. 9) to the second position. The first projection 116 disengages from the detent 108 of the catch jaw 30 when sufficient force is applied to overcome the biasing force of the first coil 94 of the spring 34 acting against the release pawl 28. Disengagement of the first projection 116 and the detent 108 releases the holding force of the first projection 116 of the release pawl 428 acting against the catch jaw 30, such that the biasing force of the second coil 96 of the spring 34 rotates the catch jaw 30 in the clockwise direction (as viewed from the back or rear side of the latch in FIG. 9) to a second position. Rotation of the catch jaw 30 to the second position by the spring 34 biases the post 106 and urges the post to move outward along the guide slot until the post 106 and recess 104 disengage. This allows the post 106 to move out of the recess 104 and disengage from the latch assembly 22. This enables the door or other item operatively connected to the post 106 to be moved relative to the latch.

Figure 10:
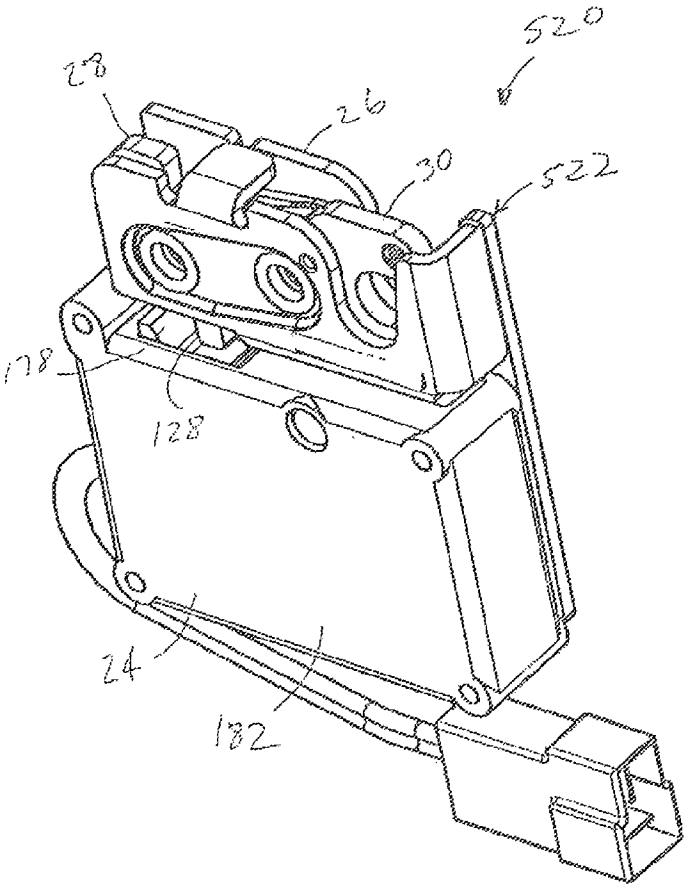
FIG. 10 is a front and right perspective view of an apparatus according to another exemplary embodiment.

FIG. 10 shows another exemplary apparatus 520 in which the actuator 24 is used with a different type of latch assembly 522. This exemplary apparatus 520 is similar to the apparatus 320 of FIGS. 7 and 8 except as discussed below. The same reference numbers will be used to designate elements of the apparatus similar in construction and function as the apparatus of figures. In this latch assembly 522, the release lever 32 and tab 50 are not present such that the latch assembly 522 may be placed in the open condition solely by operation of the actuator 24.

Figure 11:
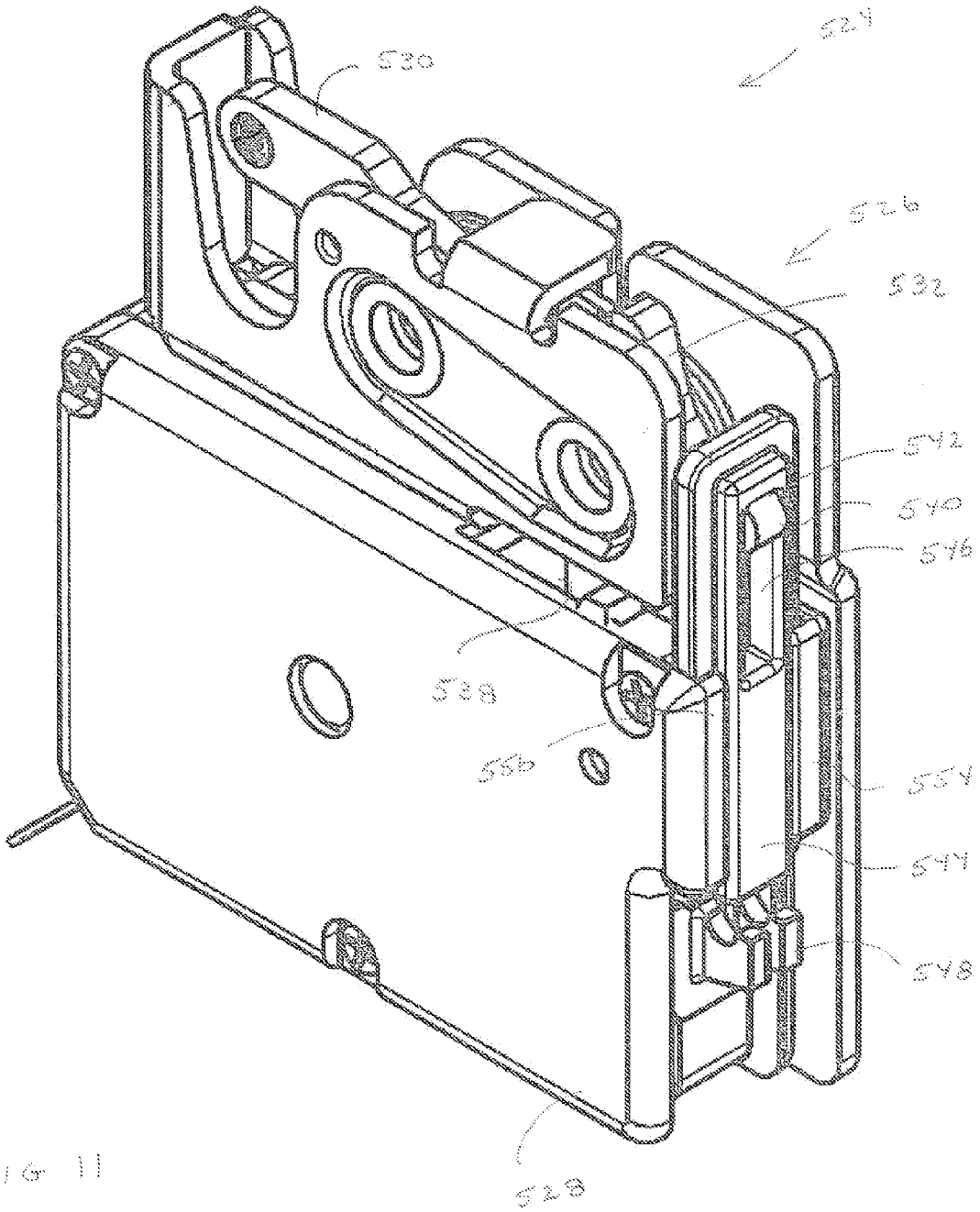
FIG. 11 is a front and right perspective view of a further alternative apparatus according to another exemplary embodiment.
Figure 12:
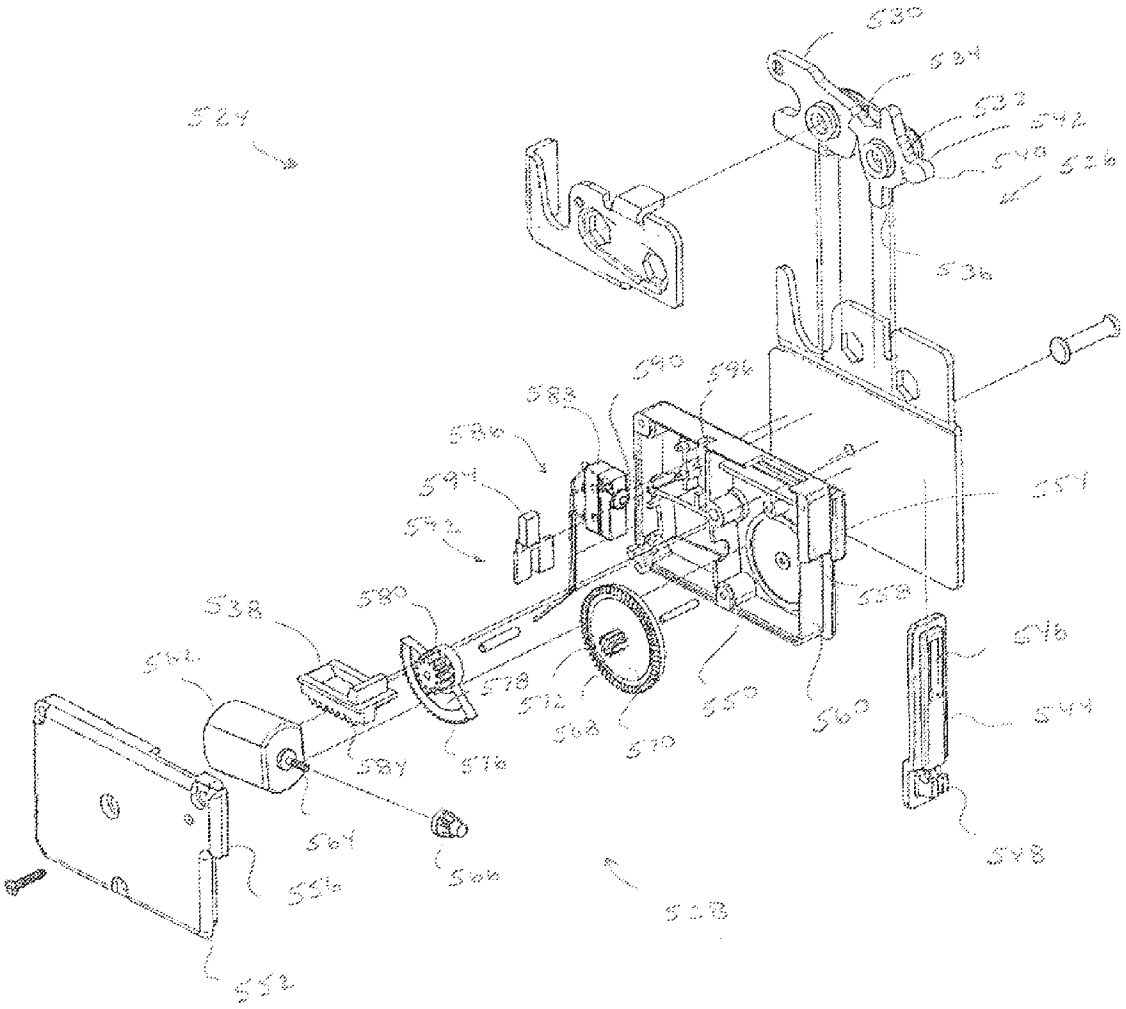
FIG. 12 is an exploded view of the apparatus shown in FIG. 11.
Figure 13:
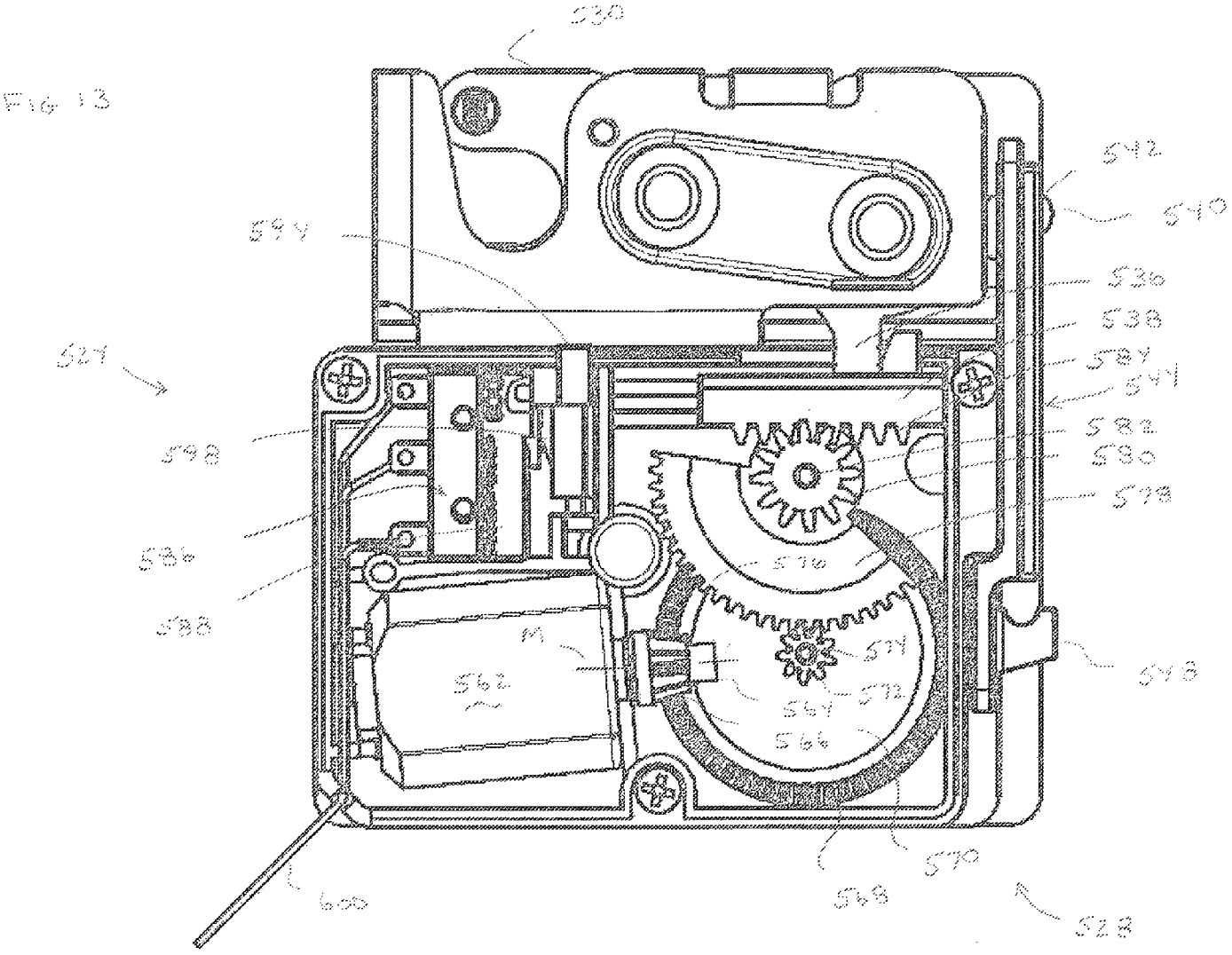
FIG. 13 is a front plan view of the apparatus shown in FIG. 11 with the front housing portion removed.
Figure 11:
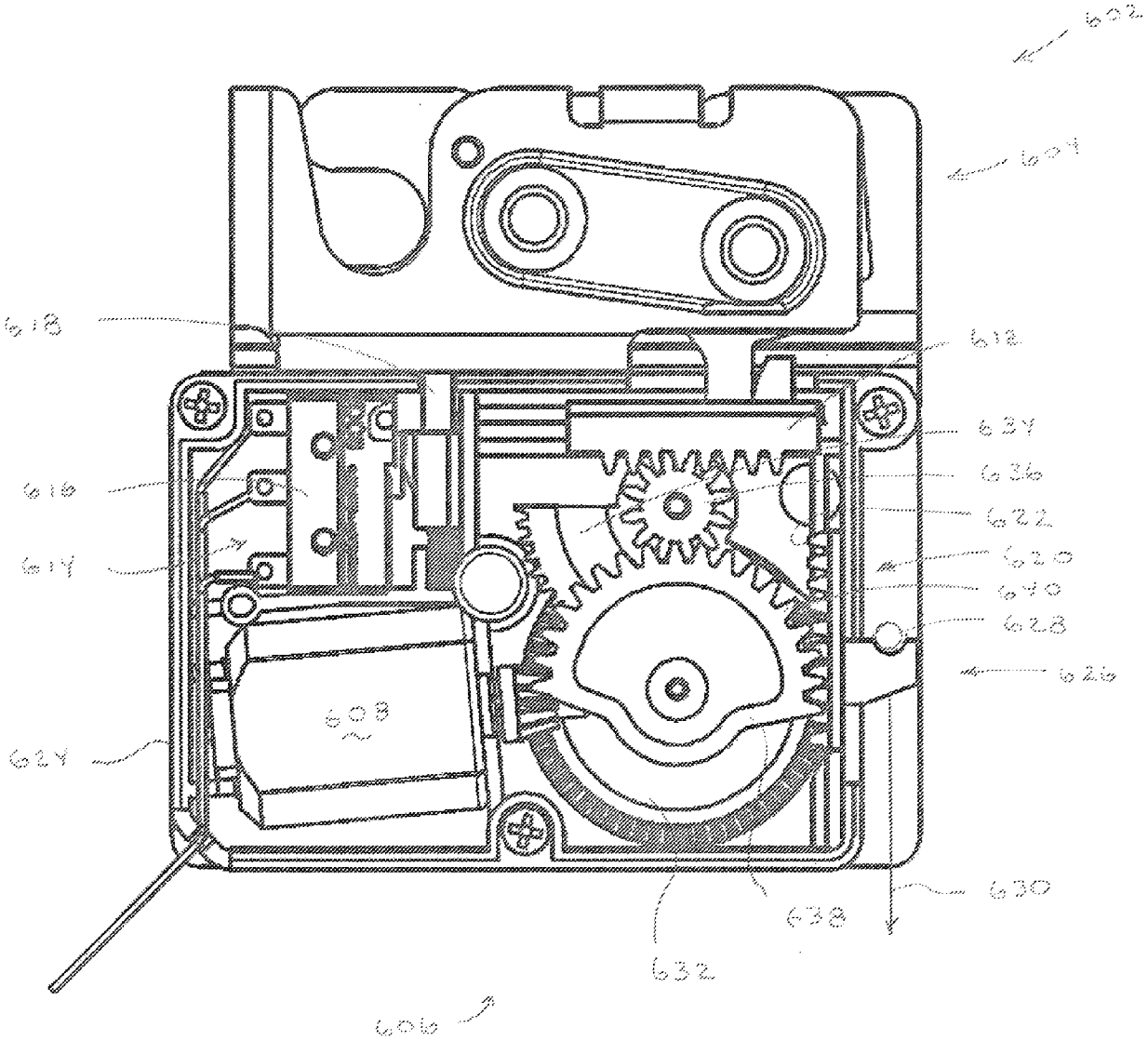

FIGS. 11-13 show a further exemplary embodiment of an apparatus 524. Apparatus 524 is generally similar to the apparatus 20 described in FIGS. 1-6 except as specifically indicated herein.

Apparatus 524 includes a latch assembly 526 and an actuator 528. The actuator is releasably engageable with the latch assembly. The latch assembly 526 includes a catch jaw 530 which has a configuration generally similar to catch jaw 30. The latch assembly also includes a release pawl 532. The release pawl 532 is generally similar in configuration to release pawl 28 with the exception that it has a different configuration. Release pawl 532 includes a projection 534 which is similar to projection 116 of the previous embodiment. Projection 534 is configured to engage a recess or detent on the catch jaw 530 so as to hold the latch assembly in the closed condition. As represented in FIG. 12, the latch assembly 526 includes a double torsion spring arrangement similar to the prior latch which serves to bias the projection 534 into engagement with the detent of the catch jaw.

The release pawl 532 further includes a release projection 536. The release projection has a configuration similar to projection 126 of the prior embodiment. The release projection 536 is configured to be movably engaged by a release member 538 of the actuator 528 in a manner similar to the prior embodiment.

The release pawl 532 of this arrangement further includes a lever engaging projection 540. The lever engaging projection 540 extends on the release pawl in a direction generally perpendicular to that of the release projection 536. The lever engaging projection is bounded at its upper side by a step surface 542.

The actuator 528 includes a release lever 544. The release lever 544 includes an aperture 546 therethrough. The aperture 546 is configured to accept the lever engaging projection 540 therein. The release lever 544 further includes at an end generally opposed of the aperture, a pair of engaging projections 548. The engaging projections 548 of the exemplary embodiment are configured to have a wire or cable extend intermediate of the projections. The wire or cable may have a cylindrical end piece or other enlarged end piece that is engaged by the arcuate recesses of the projections. This enables the wire or cable to pull the release lever in a downward direction as shown in FIG. 11. Of course it should be understood that other arrangements may be used which include release levers with other types of engaging members.

The actuator 528 of this embodiment is configured to enable the release lever to move in supported operative connection with the body of the housing. In the exemplary arrangement the actuator has a housing that includes a first casing portion 550 and a second casing portion 552. The first casing portion 550 includes a forwardly directed flange projection 554. The casing portion 552 includes a rearwardly directly flange projection 556. In the operative position of the actuator 528, flange projections 554 and 556 are configured to provide a guide slot on the exterior of the housing. The release lever is configured to be movable in supported connection with the housing and is constrained by the guide slot to move only in a generally vertical direction relative to the housing body as shown. In addition, the first casing portion includes an outward extending step portion 558. The step portion 558 underlies the guide slot and further helps to constrain the movement of the release lever along the vertical direction as shown. A recess portion 560 extends on the exterior of the casing portion 550 generally below the step portion 558. The recess portion 560 provides access for the inward extending lower portion of the release lever 544 which includes the engaging projections 548. Of course it should be understood that this configuration is exemplary and in other embodiments other arrangements may be used.

As shown in FIGS. 11 and 13, in the assembled condition of the apparatus 524 the release lever is positioned such that the lever engaging projection 540 of the release pawl extends in the aperture 546. Movement of the release lever by a wire or cable or similar actuating member in a downward direction as shown, causes the lever engaging projection 540 to be moved through engagement of the surface bounding the upper end of the aperture and the step surface 542. Clockwise rotation of the release pawl 532 as shown causes the projection 534 to move relative to the detent on the catch jaw 530. This enables the catch jaw to move from the closed condition in which the catch jaw engages the post or other member which is attached to the latched item, to an open condition in which the post is disengageable from the catch jaw. This enables the door or other item controlled by the latch to be moved to an open or unlatched condition. Of course as can be appreciated, when the latch is to be closed, the post may be moved to engage the catch jaw in the open position. Movement of the post toward the latch assembly causes rotation of the catch jaw until the projection 534 is again engaged with the detent of the catch jaw which holds the latch in the closed condition. Rotation of the release pawl and movement of the lever engaging projection 540 thereof, is enabled within the aperture of the release lever 544. The exemplary release lever 544 is configured to enable the latch assembly to be returned from the open condition to the closed condition. Of course it should be appreciated that this configuration is exemplary and in other embodiments other arrangements may be used.

The exemplary apparatus 524 is also configured to be unlatched through movement of the release member 538. This is done by moving the release projection 536 of the release pawl in a manner similar to that of the previously described embodiment. Actuator 528 includes a drive 562 which in this case includes an electric motor. The drive is operative to change the condition of the latch through a gear system 563. The electric motor includes a motor shaft 564 to which a pinion 566 is attached. Pinion 566 engages a ring gear portion 568 of a first reduction gear 570. Reduction gear 570 is operatively connected to a pinion 572 that in the exemplary arrangement is integrally formed therein. The reduction gear 570 rotates about a first axis of rotation 574.

The pinion 572 engages an arcuate gear portion 576 of a second reduction gear 578. A pinion 580 is operatively connected with reduction gear 578. Pinion 580 rotates about an axis of rotation 582. The pinion 580 engages a gear rack 584 of the release member 538 and is operative to move the release member in a linearly straight direction in a manner like that described in connection with the prior embodiment responsive to operation of the motor.

In the exemplary configuration of actuator 528 the motor 562 is positioned to provide room within the housing of the actuator for other components. Specifically in this exemplary arrangement the motor shaft 564 rotates about an axis (labeled M in FIG. 13) which extends at an angle other than perpendicular to a projection that extends between the axis of rotation 574 of the first reduction gear and the axis of rotation 582 of the second reduction gear. By positioning the drive motor 562 in this manner, rotational torque is enabled to be transmitted through the gear system so as to reliably move the release pawl and change the condition of the latch from the closed condition to the open condition. However, this arrangement also provides additional room within the housing for other components such as those described hereafter. Of course it should be understood that this arrangement is exemplary and in other embodiments other drive arrangements may be used.

In the exemplary arrangement the actuator 528 includes a switch 586. Switch 586 is an electrical switch that is operative to provide electrical signals corresponding to the position of the catch jaw 530. The exemplary switch 586 includes an electrical switch body 588. Switch body 588 includes a spring loaded actuator button 590 that extends biasingly outward from the switch body 588 (see FIG. 12). In the exemplary arrangement the electrical condition of the switch changes with the extent to which the actuator button 590 extends outward from the switch body 588.

In the exemplary arrangement switch 586 further includes a plunger member 592. Plunger member 592 includes a body portion that is movably guided vertically on guide projections that extend within casing portion 550. The plunger member 592 further includes a finger portion 594 that is sized to extend outwardly through an opening 596 in the casing portion 550. The plunger member 592 is biased by a spring (not separately shown) that urges the finger portion 594 to extend outwardly from the opening 596. In the exemplary arrangement the side of the plunger member that is in facing relation to the actuator button 590 includes a ramp surface 598. The ramp surface is configured so that when the plunger member is disposed inwardly of the housing due to engagement of the finger portion and the lower face of the catch jaw, the ramp portion disposes the actuator button 590 inwardly so that the switch body 588 is in a first electrical condition. This position of the plunger member and the electrical condition of the switch correspond to the latch assembly being in the closed condition.

When the catch jaw 530 moves to the open condition of the latch assembly, the lower surface of the catch jaw is disposed away from the actuator housing so that the finger portion 594 is disposed outwardly in response to the biasing force of the spring. The movement of the ramp portion 598 relative to the actuator button 590 causes the button to extend further outward from the switch body. This causes the switch body to be in a second electrical condition. The second electrical condition is indicative that the latch assembly is in the open condition. Suitable wiring 600 is operatively connected to the switch body 588 and extends outward from the actuator housing. Suitable electrical circuitry of the type previously discussed is operatively connected to the wiring so as to provide an indication of when the switch is in the open and/or closed conditions. Similarly in the exemplary embodiment the wiring 600 may include the wires necessary to power the motor 672.

As can be appreciated, in the exemplary arrangement suitable circuitry is provided to cause the motor 562 to rotate in a first rotational direction for purposes of changing the condition of the latch assembly from the closed condition to the open condition. In the exemplary arrangement this results from the straight linear movement of the release member 538. Once the latch has been opened, the circuitry is operative to cause the motor 562 to rotate in an opposed direction so as to cause the release member to be returned to its original position which is fully disposed to the right as shown in FIG. 13. Returning the release member 538 to this position enables the release projection 536 on the catch pawl to again extend in the recess of the release member. With the release pawl 532 in this position, the catch jaw 530 is enabled to be moved by engagement with a post or other suitable member from the open condition to a closed condition in which the release pawl holds the catch jaw so as to engage the post in generally immovable relation within the latch assembly.

In exemplary arrangements, suitable circuitry may be utilized to control the condition of the release member and the latch assembly responsive to the condition of the latch as sensed through operation of the switch 586. For example in some arrangements circuitry may operate in response to the switch indicating that the catch jaw is positioned such that the latch is in the closed condition to make a determination that the release member 538 is positioned to the retracted position shown in FIG. 13. This determination is made through operation of the control circuitry responsive to the fact that the latch is in the closed condition, which in the exemplary embodiment may only occur when the release pawl 532 is enabled to have the release projection 536 extend into engagement with the recess of release member 538.

In some exemplary arrangements the control circuitry is enabled to operate the motor 562 so as to rotate in a first direction so as to cause the latch assembly to change from the closed condition to the open condition. The change in condition of the latch assembly is sensed through operation of the switch 586. In response to sensing the change in condition of the latch, the exemplary control circuitry may reverse the direction of operation of the motor so as to return the release member 538 to its original retracted position. This may be done in some exemplary circuitry through the use of a timing function that causes the motor to operate in an opposite rotational direction that corresponds to the time that the motor rotated in a first rotational direction to cause the latch assembly to change conditions. In other arrangements the control circuitry may operate a stepper motor or other motor that measures the rotational displacement of the motor so as to provide reverse movement of the same displacement. Alternatively in other arrangements, a sensing switch may be provided in operative connection with the release member 538 to determine that the release member has been moved to the retracted or other position. In still other exemplary arrangements, the control circuitry may operate to sense the change in electrical draw by the motor which would indicate that the motor has stopped moving because the release member 538 has reached the end of its travel. In response to sensing an electrical condition corresponding to the bound and stopped condition of the motor, the circuitry may cease supplying electrical power to the motor. Of course it should be understood that these are but examples of approaches that may be used.

In still other exemplary arrangements, control circuitry used in connection with the actuator may detect the catch jaw in the open position and not include control logic which determines whether the open condition was caused through operation of the motor or manual operation of the associated manual release lever such as release lever 32 or 544. In such exemplary arrangements the control circuitry may operate in response to the switch 586 detecting that the latch is in the open condition to detect the position of the release member 538 in one of the ways previously discussed. The control circuitry may then operate the motor as appropriate to assure that the release member is in its retracted position so that the latch assembly may again be returned to the closed condition. Of course it should be understood that these approaches are exemplary and numerous other types of control circuitry and control logic may be used in connection with latch apparatus arrangements.

FIG. 14 shows a further embodiment of a latch apparatus generally indicated 602. Apparatus 602 includes a latch assembly 604 which is generally similar to latch assembly 22. Apparatus 602 further includes an actuator 606. Actuator 606 is generally similar to actuators 24 and 528 except as described herein.

The exemplary actuator 606 includes a drive 608. The latch further includes a gear system 610 which includes a pair of reduction gears that are operative to move a release member 612 in response to operation of the drive 608 in a manner like that which has been previously described.

Actuator 606 further includes a switch 614. Switch 614 includes a switch body 616 and a biased plunger member 618 which includes a finger portion that is biased to extend outwardly from the actuator housing.

Actuator 606 further includes a trip release member 620. The trip release member 620 is movably mounted in operative supported connection with the housing of the actuator 606. The exemplary trip release member 620 includes a linear gear rack 622. Gear rack 622 extends within the housing 624 of the actuator 606. The trip release member 620 and the housing 624 are configured to enable the trip release member to move relative to the housing along a generally vertical direction as shown in FIG. 14.

The exemplary trip release member 620 further includes a pair of engaging projections generally indicated 626. The pair of the engaging projections is generally similar to engaging projections 548 of the previously described embodiment. The pair of engaging projections is configured to enable a cable or wire to extend therebetween and each projection includes an arcuate surface suitable for engaging a cylindrical head at the end of the cable or wire, such as head 628 shown in FIG. 14. Movement of the cable 620 downward in the orientation shown in FIG. 14 is operative to cause the trip release member 620 to correspondingly move downward. In the exemplary arrangement the housing 624 includes a suitable rectangular aperture in the wall thereof so as to enable the trip release member to move therein.

In the exemplary arrangement of actuator 606, the gear system 610 includes a reduction gear 632 that is similar to reduction gear 570 of the previous embodiment. Reduction gear 632 is in operative connection with a further reduction gear 634 which is generally similar to reduction gear 578. Reduction gear 634 includes a pinion 636 which is in engagement with the gear rack of the release member 612 in a manner similar to that of the previously described embodiment.

Actuator 606 further includes a freewheeling gear 638. Freewheeling gear 638 is rotatable about the same axis of rotation as reduction gear 632. However, freewheeling gear 638 is configured through suitable bushings or other arrangements, to be movable independently of reduction gear 632. Freewheeling gear 638 includes an arcuate gear segment 640. Arcuate gear segment 640 is engaged with both gear rack 622 of the trip release member as well as pinion 636.

In the operation of actuator 606, the latch assembly 604 may be changed between the closed condition and the open condition through movement of the release member 612 through operation of the motor drive 608. This may be done in the manner previously described which includes operating the motor to move the release member so as to cause the release pawl to allow the catch jaw to move from the closed condition to the open condition. Likewise the motor drive may return the release member to its retracted position so that the latch assembly may again be placed in the closed condition.

Actuator 606 further enables the actuator to be changed from the closed condition to the open position through movement of the trip release member 620 without operation of the drive. This is done by moving the trip release member through displacement of the cable 630 so as to cause the gear rack 622 on the trip release member to move downward as shown in FIG. 14. This movement of the trip release member causes the freewheeling gear 638 to rotate in a clockwise direction as shown. Clockwise rotation of the freewheeling gear 638 causes the pinion 636 that is engaged therewith to rotate in a counterclockwise direction. Counterclockwise rotation of the pinion 636 causes the gear rack associated with the release member 612 to move the release member linearly to the left as shown in FIG. 14. This causes the release pawl to move such that the catch jaw of the latch assembly can change from the closed condition to the open condition.

As can be appreciated, in the exemplary arrangement of the apparatus shown in FIG. 14, movement of the release member 612 through operation of the trip release member 620 also operates to cause the reduction gears 634 and 632 to rotate in response thereto. This similarly causes the drive motor 608 to rotate as well. In this exemplary arrangement because the motor drive can be selectively generally freewheeling, the trip release member can be used to change the condition of the latch assembly to the open condition without operation of the drive. Once the latch assembly is in the open condition, this condition may be sensed through operation of the switch associated with the actuator and the control circuitry may operate the motor to cause the release member 612 to be returned to the retracted position. Further, in this exemplary arrangement the circuitry may be configured to energize the motor to oppose movement that may be imparted by the trip release member so as to selectively prevent the change in condition of the latch via the trip release member at times determined through operation of the circuitry. Of course it should be understood that these approaches are exemplary and in other arrangements, other components, drive mechanisms and control circuitry may be utilized to effectively control the condition of the exemplary latch assembly or other types of latching mechanisms.

In the foregoing description, certain terms have been described to describe example embodiments for purposes of brevity, clarity and understanding. However, no unnecessary limitations are to be implied therefrom, because such terms are used for descriptive purposes and are intended to be broadly construed. Moreover, the descriptions and illustrations herein are by way of examples and the embodiment is not limited to the features shown or described.

Further, in the following claims any feature described as a means for performing a function shall be construed as encompassing any means known to those skilled in the art as being capable of carrying out the recited function, and shall not be deemed limited to the particular means shown or described for performing the recited function in the foregoing description, or mere equivalents thereof.

Having described the features, discoveries and principles of the exemplary arrangements, the manner in which they are constructed and operated, and the advantages and useful results attained; the new and useful structures, devices, elements, arrangements, parts, combinations, systems, equipment, operations, methods, processes and relationships are set forth in the appended claims.

We claim:

1. Apparatus comprising:

an actuator configured to change a latch assembly from a closed condition in which an item is latched and generally held immovable relative to the latch assembly, to an open condition in which the item is unlatched and movable relative to the latch assembly, wherein the latch assembly includes a movable catch jaw, wherein the catch jaw in a first position is operative to engage a member operatively connected with the item when the latch assembly is in the closed condition, wherein the catch jaw in the second position is operative to enable the member to disengage from the catch jaw when the latch assembly is in the open condition, the actuator comprising:

a housing, wherein the housing is engageable in fixed operative connection with the latch assembly, a drive and a gear system within the housing, wherein the gear system is in operative connection with the drive, wherein the gear system is in operative connection with a movable release member that includes a finger that extends outside the housing, wherein the finger is movable linearly straight along a first direction outside the housing in response to operation of the drive, wherein the finger is configured to move to be in operative connection with the catch jaw such that movement of the finger in the first direction causes the catch jaw to change from being immovable from the first position to being movable from the first position to the second position.

2. The apparatus according to claim 1 and further comprising:

a switch, wherein the switch is configured to be in operative connection with the catch jaw, and wherein the switch is operative to detect that the catch jaw is in at least one of the first position and the second position.

3. The apparatus according to claim 2 wherein the latch assembly further includes a movable release pawl, wherein the release pawl includes a pawl projection, and wherein the catch jaw includes a pawl projection engaging recess, wherein the pawl projection engaging recess is configured to engage the pawl projection, and wherein engagement of the pawl projection and the pawl projection engaging recess is operative to hold the catch jaw in the first position, wherein movement of the finger in the first direction is operative to cause operative moving engagement of the release pawl and the finger, wherein the release pawl is moved responsive to finger engagement to cause the pawl projection to move relative to the pawl projection engaging recess such that the catch jaw is enabled to move from the first position to the second position.

4. The apparatus according to claim 3 wherein the gear system includes a linear gear rack, wherein the linear gear rack is in fixed operative connection with the release member.

5. The apparatus according to claim 3 wherein the release pawl includes a release projection, and wherein the release member includes a release projection engaging recess, wherein the release projection engaging recess is accessible from outside the housing and is configured to accept the release projection therein during movement of the finger in the first direction.

6. The apparatus according to claim 1 wherein the gear system includes two pairs of reduction gears, wherein each pair of reduction gears includes a relatively larger arcuate gear portion and relatively smaller coaxial pinion gear portion in fixed operative connection with the relatively larger arcuate gear portion, wherein the drive includes a rotatable drive shaft and a drive pinion gear in operative connection with the drive shaft, wherein the drive pinion gear is directly engaged with the relatively larger arcuate gear portion of a first reduction gear pair, wherein the relatively larger arcuate gear portion of a second reduction gear pair is directly engaged with the relatively smaller pinion gear portion of the first reduction gear pair.

7. The apparatus according to claim 6 wherein the first pair of reduction gears is rotatable relative to the housing about a first axis of rotation, wherein the second pair of reduction gears is rotatable relative to the housing about a second axis of rotation, wherein the rotatable drive shaft extends perpendicular relative to the first axis of rotation and extends at an angle other than perpendicular to a line projecting through both the first axis of rotation and the second axis of rotation.

8. The apparatus according to claim 3 wherein the release pawl includes a further step surface, wherein the further step surface is configured to be movably engageable with a movable release lever, wherein absent movement by finger engagement, the release pawl is movable to cause release movement of the pawl projection and the pawl projection engaging recess of the catch jaw responsive to movement of the release lever.

9. The apparatus according to claim 8 wherein the release lever is movably mounted in supported operative connection with the actuator housing.

10. The apparatus according to claim 9 wherein the release lever includes an aperture, and wherein the further step surface is extendable in the aperture.

11. The apparatus according to claim 9 wherein the housing includes an externally accessible guide slot, wherein the release lever is movable relative to the housing in the guide slot.

12. The apparatus according to claim 8 and further comprising:

a trip release member, wherein the trip release member is movably mounted in supported operative connection with the housing, wherein movement of the trip release lever relative to the housing is operative to cause release member movement in the first direction without operation of the drive.

13. The apparatus according to claim 1 and further comprising:

a trip release member, wherein the trip release member is movably mounted in supported operative connection with the housing, wherein movement of the trip release lever relative to the housing is operative to cause release member movement in the first direction without operation of the drive.

14. Apparatus comprising:

an actuator configured to operate a latch, wherein the latch is configured to be in a closed condition wherein the latch engages an item, and a open condition wherein the latch disengages the item, wherein the latch includes a movable catch jaw, wherein in the closed condition the catch jaw is in a first position, is immovable and is operative in the first position to hold in fixed engagement with the latch a member operatively connected to the item, and wherein in the open condition the catch jaw is movable from the first position to the second position, wherein in the second position the catch jaw enables the member to disengage from the catch jaw, wherein the actuator includes a housing, wherein a drive is housed within the housing, wherein the drive is in operative connection with a movable release member, wherein the release member extends within and outside the housing, wherein a portion of the release member is operative to linearly move along a straight line in a first direction outside the housing in response to operation of the drive, wherein the linear movement of the release member in the first direction causes the portion to move from a position in which the portion is not operatively engaged with the catch jaw to a further position in which the portion is operatively engaged with the catch jaw, wherein movement of the portion in the first direction from the further position causes the catch jaw to be movable from the first position to the second position.

15. The apparatus according to claim 14 wherein the latch further includes a movable release pawl, wherein the release pawl is in contacting connection with the catch jaw, wherein the release pawl is operative in a first pawl position to engagingly hold the catch jaw immovable in the first position, and wherein movement of the release pawl to a second pawl position enables the catch jaw to be movable from the first position to the second position, wherein the release pawl includes a release projection, wherein in the further position the release projection is moved in the first direction in operative engagement with the portion of the release member to the second pawl position.

16. The apparatus according to claim 15 wherein the release member includes a release projection engaging recess that is accessible from outside the housing, wherein the release projection extends in the release projection engaging recess during movement of the portion in the first direction.

17. The apparatus according to claim 15 wherein the release pawl of the latch includes a further release projection, a release lever, wherein the release lever is movably mounted in supported operative connection with the housing, wherein the release lever is movably engageable with the further release projection, wherein movement of the release lever is operative to cause movement of the release pawl which enables the catch jaw to be movable from the first position to the second position without movement of the release member.

18. The apparatus according to claim 15 and further including a trip release lever movably mounted in supported operative connection with the housing, wherein the trip release lever is configured to cause release member movement in the first direction responsive to movement of the trip release lever without operation of the drive.

19. Apparatus comprising:

a latch, wherein the latch is changeable between a closed condition in which the latch holds an item in engaged relation, and an open condition in which the item is disengageable from the latch, the latch including a movable catch jaw, wherein the catch jaw is movable relative to the latch between a first jaw position in which the catch jaw holds the item in engagement with the latch, a second jaw position in which the item is disengageable from the latch jaw, a movable release pawl, wherein the release pawl is movable relative to the latch between a first pawl position and a second pawl position, wherein in the first pawl position the release pawl engages the catch jaw and holds the catch jaw fixed in the first jaw position, wherein in the second pawl position the release pawl enables the catch jaw to be movable from the first jaw position to the second jaw position, wherein the release pawl includes a release projection, at least one spring, wherein the at least one spring biases the catch jaw toward the second jaw position and the release pawl toward the first pawl position, a latch actuator, wherein the latch actuator is in fixed operative connection with the latch, wherein the latch actuator includes a drive, and a release member, wherein the release member is selectively movable along a straight linear direction responsive to the drive, wherein linear movement of the release member is operative to engage the release projection and move the pawl against the force of the at least one spring from the first pawl position to the second pawl position, wherein with the release pawl in the second pawl position the catch jaw moves responsive to the force of the at least one spring from the first jaw position to the second jaw position, whereby the item is disengageable from the catch jaw and the latch is changed from the closed condition to the open condition.

20. Apparatus comprising:

an actuator configured to change a latch from a closed condition in which an item is latched and generally held immovable relative to the latch, to an open condition in which the item is unlatched and movable relative to the latch, and wherein the latch includes a movable catch jaw, wherein the catch jaw in a first position is operative to engage a member operatively connected with the item when the latch is in the closed condition, wherein the catch jaw in the second position is operative to enable the member to disengage from the catch jaw when the latch is in the open condition, the actuator comprising:

a housing, wherein the housing is engageable in fixed operative connection with the latch, a drive and a gear system within the housing, wherein the gear system is in operative connection with the drive, wherein the gear system is in operative connection with a movable release member, wherein the release member is movable in a linearly straight first direction in response to operation of the drive, wherein the release member is configured to be in operative connection with the catch jaw such that movement of the release member in the first direction enables the catch jaw to be movable to the second position, a switch, wherein the switch includes a switch body a plunger, wherein the plunger is movable relative to the switch body, wherein the switch body is housed within the housing and the plunger extends outside the housing, wherein the catch jaw is operatively engageable with the plunger and is operative to cause the plunger to move relative to the switch body responsive to movement of the catch jaw, wherein the switch is operative to detect that the catch jaw is in at least one of the first position and the second position.

21. Apparatus comprising an actuator configured to change a latch assembly from a closed condition in which an item is latched and generally held immovable relative to the latch assembly, to an open condition in which the item is unlatched and movable relative to the latch assembly, and wherein the latch assembly includes a movable catch jaw, wherein the catch jaw in a first position is operative to engage a member operatively connected with the item when the latch assembly is in the closed condition, wherein the catch jaw in the second position is operative to enable the member to disengage from the catch jaw when the latch assembly is in the open condition, the actuator comprising:

a housing, wherein the housing is engageable in fixed operative connection with the latch assembly, a drive and a gear system with the housing, wherein the gear system is in operative connection with the drive, wherein the gear system is in operative connection with a movable release member that includes a finger that extends outside the housing, wherein the finger is movable linearly straight along a first direction outside the housing in response to operation of the drive, wherein the finger is configured to move to be in operative connection with the catch jaw such that movement of the finger in the first direction enables the catch jaw to be movable from the first position to the second position, a switch, wherein the switch extends in the housing, and wherein the switch includes a switch body and a plunger, wherein the switch body is housed within the housing and wherein the plunger extends outside the housing, wherein the switch is configured such that the catch jaw is operatively engageable with the plunger and is operative to cause the plunger to move relative to the switch body responsive at least in part to movement of the catch jaw from the second position to the first position, wherein the switch is operative to detect that the catch jaw is in at least one of the first position and the second position.

* * * * *